US008213833B2

(12) United States Patent
Yagi et al.

(10) Patent No.: US 8,213,833 B2
(45) Date of Patent: Jul. 3, 2012

(54) IMAGE FORMING APPARATUS, PROCESS CARTRIDGE, IMAGE FORMING METHOD AND DEVELOPER FOR ELECTROPHOTOGRAPHY

(75) Inventors: Shinichiro Yagi, Numazu (JP); Tomio Kondou, Numazu (JP); Masashi Nagayama, Mishima (JP); Hltoahi Iwatsuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 969 days.

(21) Appl. No.: 12/013,108

(22) Filed: Jan. 11, 2008

(65) Prior Publication Data

US 2008/0171274 A1 Jul. 17, 2008

(30) Foreign Application Priority Data

Jan. 15, 2007 (JP) ..... 2007-005389

(51) Int. Cl.
*G03G 15/08* (2006.01)

(52) U.S. Cl. ..... 399/159; 430/111.1; 430/111.35; 430/111.4; 430/111.41; 430/123.41

(58) Field of Classification Search ..... 399/159; 430/111.1, 111.35, 111.4, 111.41, 123.41
See application file for complete search history.

(56) References Cited

U.S. PATENT DOCUMENTS

| | | | |
|---|---|---|---|
| 5,380,616 | A | 1/1995 | Aoki et al. |
| 5,519,316 | A | 5/1996 | Hagiwara et al. |
| 5,879,849 | A | 3/1999 | Sawada et al. |
| 5,882,832 | A | 3/1999 | Tosaka et al. |
| 6,183,926 | B1 | 2/2001 | Kuroda et al. |
| 6,258,502 | B1 | 7/2001 | Nakamura et al. |
| 6,403,275 | B1 | 6/2002 | Kuramoto et al. |
| 6,479,204 | B1 | 11/2002 | Uchinokura et al. |
| 6,503,676 | B2 | 1/2003 | Yamashita et al. |
| 6,630,276 | B2 | 10/2003 | Sugiura et al. |
| 6,641,969 | B2 | 11/2003 | Uchinokura et al. |
| 6,733,939 | B2 | 5/2004 | Nanya et al. |
| 6,757,507 | B2 | 6/2004 | Mochizuki et al. |
| 6,780,556 | B2 | 8/2004 | Sugiura et al. |

(Continued)

FOREIGN PATENT DOCUMENTS

| | | |
|---|---|---|
| JP | 58-108548 | 6/1983 |

(Continued)

OTHER PUBLICATIONS

Translation of JP 09-160304 published Dec. 1995.*

(Continued)

*Primary Examiner* — Peter Vajda
(74) *Attorney, Agent, or Firm* — Oblon, Spivak, McClelland, Maier & Neustadt, L.L.P.

(57) ABSTRACT

An image forming apparatus including at least an image bearer; a charger charging the image bearer; an irradiator irradiating the image bearer to form an electrostatic latent image thereon; an image developer developing the electrostatic latent image with a developer comprising a toner and a carrier to form a toner image on the image bearer; a developer feeder feeding a supplemental developer including the toner and the carrier into the image developer; and a developer collector collecting the developer in the image developer, wherein the developer feeder includes a cylindrical supplemental developer container containing the supplemental developer, including a spiral developer guide race on the inner circumferential surface thereof; and a sub-hopper configured to store the supplemental developer, and wherein the carrier includes a core material; and a layer coated on the core material, including a binder resin and non-black or a non-color inorganic particulate material.

11 Claims, 5 Drawing Sheets

U.S. PATENT DOCUMENTS

| | | | | |
|---|---|---|---|---|
| 6,787,280 | B2 | 9/2004 | Yamashita et al. | |
| 6,818,370 | B2 | 11/2004 | Uchinokura et al. | |
| 6,821,699 | B2 | 11/2004 | Kondou et al. | |
| 6,849,369 | B2 | 2/2005 | Yagi et al. | |
| 6,852,462 | B2 | 2/2005 | Emoto et al. | |
| 6,902,857 | B2 | 6/2005 | Yagi et al. | |
| 6,902,858 | B2 | 6/2005 | Mochizuki et al. | |
| 6,916,587 | B2 | 7/2005 | Fushimi et al. | |
| 6,936,390 | B2 | 8/2005 | Nanya et al. | |
| 6,939,653 | B2 | 9/2005 | Suzuki et al. | |
| 6,947,692 | B2 | 9/2005 | Kondo et al. | |
| 7,029,816 | B2 | 4/2006 | Sasaki et al. | |
| 7,052,815 | B2 | 5/2006 | Sawada et al. | |
| 7,056,636 | B2 | 6/2006 | Tomita et al. | |
| 7,056,638 | B1 | 6/2006 | Tomita et al. | |
| 7,060,407 | B2 | 6/2006 | Nagayama et al. | |
| 7,083,890 | B2 | 8/2006 | Emoto et al. | |
| 7,129,013 | B2 | 10/2006 | Higuchi et al. | |
| 7,132,210 | B2 | 11/2006 | Suzuki et al. | |
| 7,144,669 | B2 | 12/2006 | Suzuki et al. | |
| 7,157,199 | B2 | 1/2007 | Emoto et al. | |
| 7,157,201 | B2 | 1/2007 | Tomita et al. | |
| 7,163,774 | B2 | 1/2007 | Shiraishi et al. | |
| 7,172,846 | B2 | 2/2007 | Yamashita et al. | |
| 7,217,485 | B2 | 5/2007 | Hasegawa et al. | |
| 7,217,487 | B2 | 5/2007 | Nanya et al. | |
| 7,226,713 | B2 | 6/2007 | Yamashita et al. | |
| 7,232,632 | B2 | 6/2007 | Kondou et al. | |
| 7,235,338 | B2 | 6/2007 | Takada et al. | |
| 7,241,545 | B2 | 7/2007 | Nanya et al. | |
| 7,252,919 | B2 | 8/2007 | Suzuki et al. | |
| 7,272,347 | B2 | 9/2007 | Yamashita et al. | |
| 7,303,847 | B2 | 12/2007 | Tomita et al. | |
| 2002/0039698 | A1 | 4/2002 | Sasaki et al. | |
| 2003/0123896 | A1* | 7/2003 | Goto et al. | 399/90 |
| 2003/0138273 | A1* | 7/2003 | Ichikawa et al. | 399/262 |
| 2003/0180643 | A1 | 9/2003 | Suzuki et al. | |
| 2004/0131961 | A1 | 7/2004 | Watanabe et al. | |
| 2004/0229147 | A1 | 11/2004 | Higuchi et al. | |
| 2004/0234877 | A1* | 11/2004 | Yoshino et al. | 430/108.1 |
| 2004/0253528 | A1* | 12/2004 | Yamashita et al. | 430/111.35 |
| 2005/0079434 | A1* | 4/2005 | Suzuki et al. | 430/111.41 |
| 2005/0089786 | A1 | 4/2005 | Sugiura et al. | |
| 2005/0112488 | A1 | 5/2005 | Yamada et al. | |
| 2005/0158643 | A1 | 7/2005 | Yamaguchi et al. | |
| 2005/0164114 | A1 | 7/2005 | Yagi et al. | |
| 2005/0180786 | A1 | 8/2005 | Yamada et al. | |
| 2005/0186498 | A1 | 8/2005 | Honda et al. | |
| 2005/0238980 | A1 | 10/2005 | Yamashita et al. | |
| 2005/0260516 | A1 | 11/2005 | Tomita et al. | |
| 2006/0024604 | A1 | 2/2006 | Sugiura et al. | |
| 2006/0024606 | A1 | 2/2006 | Suzuki et al. | |
| 2006/0057487 | A1 | 3/2006 | Nagayama et al. | |
| 2006/0127152 | A1 | 6/2006 | Nagayama et al. | |
| 2006/0154168 | A1 | 7/2006 | Tomita et al. | |
| 2006/0204883 | A1 | 9/2006 | Nakayama et al. | |
| 2006/0210905 | A1 | 9/2006 | Imahashi et al. | |
| 2006/0210906 | A1 | 9/2006 | Suzuki et al. | |
| 2006/0222987 | A1 | 10/2006 | Suzuki et al. | |
| 2006/0240349 | A1 | 10/2006 | Watanabe et al. | |
| 2006/0251982 | A1 | 11/2006 | Iwatsuki et al. | |
| 2006/0291911 | A1 | 12/2006 | Yamashita et al. | |
| 2007/0015078 | A1 | 1/2007 | Suzuki et al. | |
| 2007/0020546 | A1 | 1/2007 | Emoto et al. | |
| 2007/0031748 | A1 | 2/2007 | Kotsugai et al. | |
| 2007/0031752 | A1 | 2/2007 | Watanabe et al. | |
| 2007/0048652 | A1 | 3/2007 | Imahashi et al. | |
| 2007/0140749 | A1 | 6/2007 | Miyamoto et al. | |
| 2007/0202430 | A1 | 8/2007 | Suzuki et al. | |
| 2007/0243482 | A1 | 10/2007 | Yamaguchi et al. | |
| 2008/0017272 | A1* | 1/2008 | Isomura et al. | 141/67 |

FOREIGN PATENT DOCUMENTS

| | | |
|---|---|---|
| JP | 1-19584 | 4/1989 |
| JP | 2-21591 | 5/1990 |
| JP | 3-628 | 1/1991 |
| JP | 3-145678 | 6/1991 |
| JP | 5-241445 | 9/1993 |
| JP | 5-273789 | 10/1993 |
| JP | 6-202381 | 7/1994 |
| JP | 7-140723 | 6/1995 |
| JP | 09-160304 | * 12/1995 |
| JP | 8-6307 | 1/1996 |
| JP | 8-179570 | 7/1996 |
| JP | 8-234550 | 9/1996 |
| JP | 8-286429 | 11/1996 |
| JP | 9-160304 | 6/1997 |
| JP | 2683624 | 8/1997 |
| JP | 9-258482 | 10/1997 |
| JP | 11-202537 | 7/1999 |
| JP | 11-202630 | 7/1999 |
| JP | 11-223960 | 8/1999 |
| JP | 2000-122359 | 4/2000 |
| JP | 2004-29306 | 1/2004 |
| JP | 2004-139031 | 5/2004 |
| JP | 2004-264510 | 9/2004 |
| JP | 2004-309721 | 11/2004 |
| JP | 2005-292511 | 10/2005 |
| JP | 2005-338332 | 12/2005 |
| JP | 2006-78633 | 3/2006 |
| JP | 2006-154019 | 6/2006 |
| JP | 2006-154453 | 6/2006 |

OTHER PUBLICATIONS

Submission of Information issued Jan. 15, 2010 in Japan Application (With English Translation).

Office Action issued May 19, 2011 in Japan Application No. 2007-005389.

* cited by examiner

IMAGE FORMING APPARATUS, PROCESS CARTRIDGE, IMAGE FORMING METHOD AND DEVELOPER FOR ELECTROPHOTOGRAPHY

BACKGROUND OF THE INVENTION

1. Field of the Invention

The present invention relates to an image forming apparatus forming images by an electrostatic duplicating process, such as a copier, a facsimile and a printer. Further, the present invention relates to a process cartridge installed therein, an image forming method and a developer for electrophotography applied therefor.

2. Discussion of the Background

In an electrophotographic image forming apparatus such as a copier or a printer, an image bearer uniformly charged is irradiated to form a latent image thereon; the latent image is developed with a toner to form a toner image; and the toner image is transferred onto a transfer material such as a recording paper. The transfer material bearing the toner image passes through a fixer wherein the toner image is fixed thereon upon application of heat or pressure.

In the image forming apparatus, an image developer developing the latent image on the image bearer uses a one-component developing method using a toner including a magnetic material or a two-component developing method using a developer including a toner and a carrier.

The image developer using the two-component developing method has good developability and is used for most of the image forming apparatuses currently used. Particularly in recent years, many color-image forming apparatuses forming full-color or multi-color images are used, and demand for the image developer using the two-component developing method is further increasing.

The toner and carrier are stirred in the image developer using the two-component developing method, and the toner is frictionally-charged with the carrier and electrostatically attracted to the outer surface of the carrier. The carrier bearing the toner is transported to a developing area where the toner leaves from the carrier and electrostatically adheres to the latent image on the image bearer upon application of developing bias to form a toner image. Therefore, in the two-component developing method, it is essential that the carrier stably charges the toner when stirred before and after used for long periods to produce images satisfying high durability and stability.

In the typical image developer using a two-component developer, a toner is consumed and a carrier remains therein in the mean time while developing images. Therefore, the carrier being stirred with the toner deteriorates as it is more frequently stirred therewith because a resin coated on the carrier peels and the toner adheres thereto. Accordingly, the resistivity of the carrier and the chargeability of the developer gradually deteriorate, and the developability of the developer excessively increases. Resultantly, image density excessively increases and foggy images are produced.

In order to solve this problem, Japanese Published Examined Patent Application No. 2-21591 discloses a trickle image developer wherein a carrier is gradually replaced while a toner is consumed for developing images to prevent variation of the charge quantity of the developer for stabilizing the image density.

However, even in the image developer disclosed in Japanese Published Examined Patent Application No. 2-21591, deteriorated carrier gradually increases as the developer is used for a long time and it is difficult to prevent increase of the image density.

Japanese Published Unexamined Patent Application No. 3-14 5678 discloses a supplemental developer to be properly fed in the image developer, wherein a carrier has a higher resistivity than that of a carrier readily contained in the image developer to maintain the chargeability and prevent deterioration of image quality.

Further, Japanese Published Unexamined Patent Application No. 11-223960 discloses a supplemental developer including a carrier imparting higher charge quantity to a toner to maintain the chargeability and prevent deterioration of image quality.

However, the carrier quantity replaced in the image developer differs with the difference of the toner consumption, the resistivity or charge quantity of the developer disclosed in Japanese Published Unexamined Patent Applications Nos. 3-145678 and 11-223960 varies, resulting in variation of image density.

Japanese Published Unexamined Patent Application No. 8-234550 discloses a method of sequentially feeding plural developers including carriers having different properties from those of a carrier readily contained in an image developer.

However, practically, it is quite difficult to feed sequentially feeding the plural developers including carriers having different properties in the image developer so as not be mixed with each other because the specific gravities of a toner and a carrier are extremely different from each other. In addition, the carrier tends to deteriorate because the toner quantity is too large for the carrier in the developer, and which does not produce images having stable quality.

As disclosed in Japanese Published Unexamined Patent Application No. 8-234550, when silicone-coated layer coated on a core material of the carrier is simply increased to increase the resistivity of the supplemental carrier, the charge quantity of the carrier decreases although the resistivity thereof increases, resulting in deterioration of reproducibility of images and occurrence of background fouling.

Therefore, in the trickle developing method, it is essential that the carrier can maintain stable chargeability even when used for long periods.

Japanese Published Unexamined Patent Application No. 58-108548 discloses coating a granulated carrier for use in a two-component developer with a proper resin for the purpose of preventing a toner from filming over the carrier, forming a uniform surface thereof, preventing the surface thereof from being oxidized, preventing deterioration of moisture sensitivity thereof, extending a life of the developer, protecting a photoreceptor from being scratched or abraded with the carrier, controlling a charge polarity, adjusting charge quantity, etc; and Japanese Published Examined Patent Applications Nos. 1-19584 and 3-628, and Japanese Published Unexamined Patent Application No. 6-202381 disclose a method of adding various additives to the coated layer.

Further, Japanese Published Unexamined Patent Application No. 5-273789 discloses a carrier, the surface of which an additive adheres to, and Japanese Published Unexamined Patent Application No. 9-160304 discloses a carrier including an electroconductive particulate material larger than the thickness of a coated layer thereof.

Japanese Published Unexamined Patent Application No. 8-6307 discloses using a carrier coating material mainly including a benzoguanamine-n-butylalcohol-formaldehyde copolymer, and Japanese Patent No. 2683624 discloses using crosslinked material between a melamine resin and an acrylic resin as a carrier coating material.

However, even these carriers still have problems in their durabilities or heat resistances, and problems spent carrier, unstable charge quantity and foggy images. Further, the environmental resistance needs improvement.

In addition, a resistivity adjuster is conventionally included in a carrier in a two-component developer to have stable chargeability. Carbon black is mostly used as the resistivity adjuster.

However, when such a carrier is used in a color image forming apparatus, the surface of the carrier is abraded or carbon black leaves therefrom and transfers in color images, resulting in possible color contamination.

Various methods are disclosed to prevent this phenomenon.

For example, Japanese Published Unexamined Patent Application No. 7-140723 discloses a carrier wherein an electroconductive material (carbon black) is present on the surface of a core material and not in a coated layer.

Japanese Published Unexamined Patent Application No. 8-179570 discloses a carrier having a concentration gradient of carbon black in its coated layer, wherein the concentration becomes lower toward the surface thereof and carbon black is not present at the surface thereof.

Japanese Published Unexamined Patent Application No. 8-286429 discloses a double-coated carrier wherein an inner coated layer including electroconductive carbon is formed on the surface of a core material and a coated layer including a white electroconductive material is formed thereon.

However, recently, electrophotographic image forming apparatus is noticeably required to form an image at higher speed, and a developer receives stress more and more. Therefore, it is difficult to completely prevent the color contamination caused by transfer of carbon black in images even with the carriers disclosed in Japanese Published Unexamined Patent Applications Nos. 7-140723, 8-179570 and 8-286429.

Japanese Published Unexamined Patent Application No. 2004-29306 discloses a feeder feeding a supplemental developer.

However, higher speed and higher quality need a uniform concentration of a toner and a carrier. When a large amount of the carrier is fed into a developer tank, the supplemental developer is late in discharging from the developer tank and the amount of the developer therein temporarily increases. When the amount of the developer therein increases, e.g., when the toner concentration is controlled by detecting a magnetic permeability, the developer fed per unit of time a magnetic permeability sensor detects increases. The density of the developer at the detection surface increases and the magnetic permeability sensor indicates a high magnetic permeability. Therefore, the supplemental developer is further fed to maintain an initial standard, resulting in feeding of the developer having a toner concentration higher than the standard. On the contrary, when the amount of the developer therein decreases, the developer having a toner concentration lower than the standard is fed. Thus, the image density varies. Japanese Published Unexamined Patent Application No. 2004-29306 specifies the specific gravity of the supplemental developer. A carrier having low specific gravity somewhat improves the uniformity of concentrations of the toner and carrier. However, a carrier having high specific gravity does not. In addition, the carrier having high specific gravity is likely to cause an excessive supply (flashing) of the toner, resulting in scattering of the toner from feeding route thereof.

Because of these reasons, a need exists for an image forming apparatus using a two-component developer, stably producing high-quality images, having high durability, preventing a carrier from adhering to a solid image, and producing no contaminated color image.

SUMMARY OF THE INVENTION

Accordingly, an object of the present invention is to provide an image forming apparatus using a two-component developer, stably producing high-quality images, having high durability, preventing a carrier from adhering to a solid image, and producing no contaminated color image.

Another object of the present invention is to provide a process cartridge installed in the image forming apparatus.

A further object of the present invention is to provide an image forming method used in the image forming apparatus.

Another object of the present invention is to provide a developer for electrophotography used in the image forming apparatus.

These objects and other objects of the present invention, either individually or collectively, have been satisfied by the discovery of an image forming apparatus, comprising:

an image bearer configured to bear an image;

a charger configured to charge the image bearer;

an irradiator configured to irradiate the image bearer to form an electrostatic latent image thereon;

an image developer configured to develop the electrostatic latent image with a developer comprising a toner and a carrier to form a toner image on the image bearer;

a transferer configured to transfer the toner image onto a receiving material;

fixer configured to fix the toner image on the receiving material;

a developer feeder configured to feed a supplemental developer comprising the toner and carrier into the image developer; and a developer collector configured to collect the developer in the image developer, wherein the developer feeder comprises:

a cylindrical supplemental developer container configured to contain the supplemental developer, comprising a spiral developer guide race on the inner circumferential surface thereof; and a sub-hopper configured to store the supplemental developer, and wherein the carrier comprises:

a core material; and a layer coated on the core material, comprising a non-black or a non-color inorganic particulate material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image forming apparatus using a two-component developer, stably producing high-quality images, having high durability, preventing a carrier from adhering to a solid image, and producing no contaminated color image.

More particularly, the present invention relates to an image forming apparatus, comprising:

an image bearer configured to bear an image;

a charger configured to charge the image bearer;

an irradiator configured to irradiate the image bearer to form an electrostatic latent image thereon;

an image developer configured to develop the electrostatic latent image with a developer comprising a toner and a carrier to form a toner image on the image bearer;

a transferer configured to transfer the toner image onto a receiving material;

fixer configured to fix the toner image on the receiving material;

a developer feeder configured to feed a supplemental developer comprising the toner and carrier into the image developer; and a developer collector configured to collect the developer in the image developer, wherein the developer feeder comprises:

a cylindrical supplemental developer container configured to contain the supplemental developer, comprising a spiral developer guide race on the inner circumferential surface thereof; and a sub-hopper configured to store the supplemental developer, and wherein the carrier comprises:

a core material; and a layer coated on the core material, comprising a non-black or a non-color inorganic particulate material.

Figure 1:
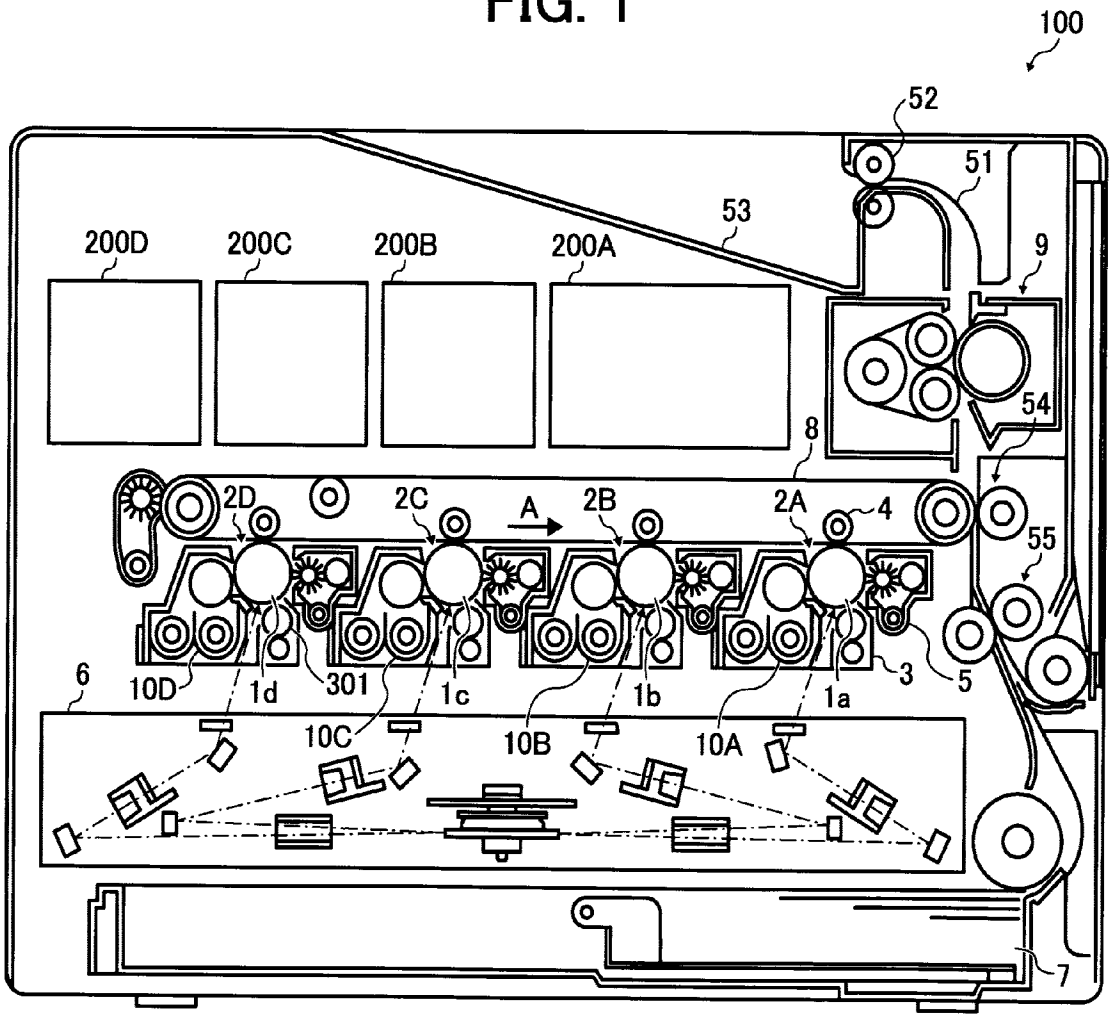
FIG. 1 is a schematic view illustrating an embodiment of the image forming apparatus of the present invention.

FIG. 1 is a schematic view illustrating an embodiment of the image forming apparatus of the present invention.

Four image forming units 2A, 2B, 2C and 2D having image bearers which are photoreceptors 1*a*, 1*b*, 1*c* and 1*d*, respectively are installed in an image forming apparatus 100, detachable therefrom. Almost in the center thereof, a transferer 4 including a transfer belt 8 rotatable in the direction of an arrow A between plural rollers.

The photoreceptors 1*a*, 1*b*, 1*c* and 1*d* in the image forming units 2A, 2B, 2C and 2D contact the under surface of the transfer belt 8. The image forming units 2A, 2B, 2C and 2D include image developers 10A, 10B, 10C and 10D using different color toners, respectively.

The image forming units 2A, 2B, 2C and 2D have the same constitutions, and the image forming unit 2A forms a magenta color images, 2B forms a cyan color image, 2C forms a yellow color image and 2D forms a black color image.

Each of the image developers 10A, 10B, 10C and 10D uses a two-component developer including a toner and a carrier, and a developer feeder 200 mentioned later feeds both a toner depending on an output of a toner concentration sensor (not shown) installed in a developer container 14 and a carrier, and discharges an old developer to replace the developer.

Figure 2:
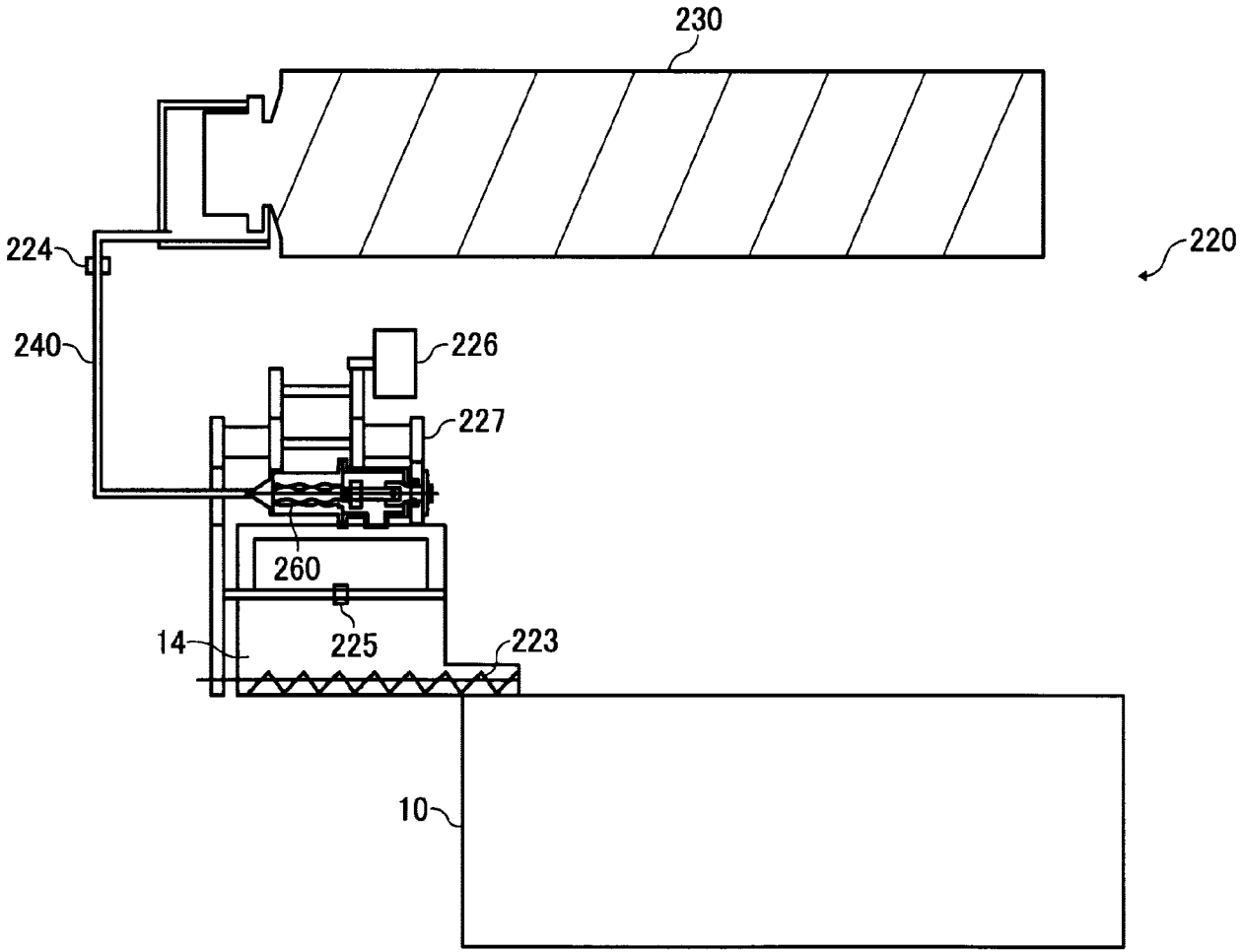
FIG. 2 is a schematic view illustrating the developer feeding device for use in the present invention.
Figure 3:
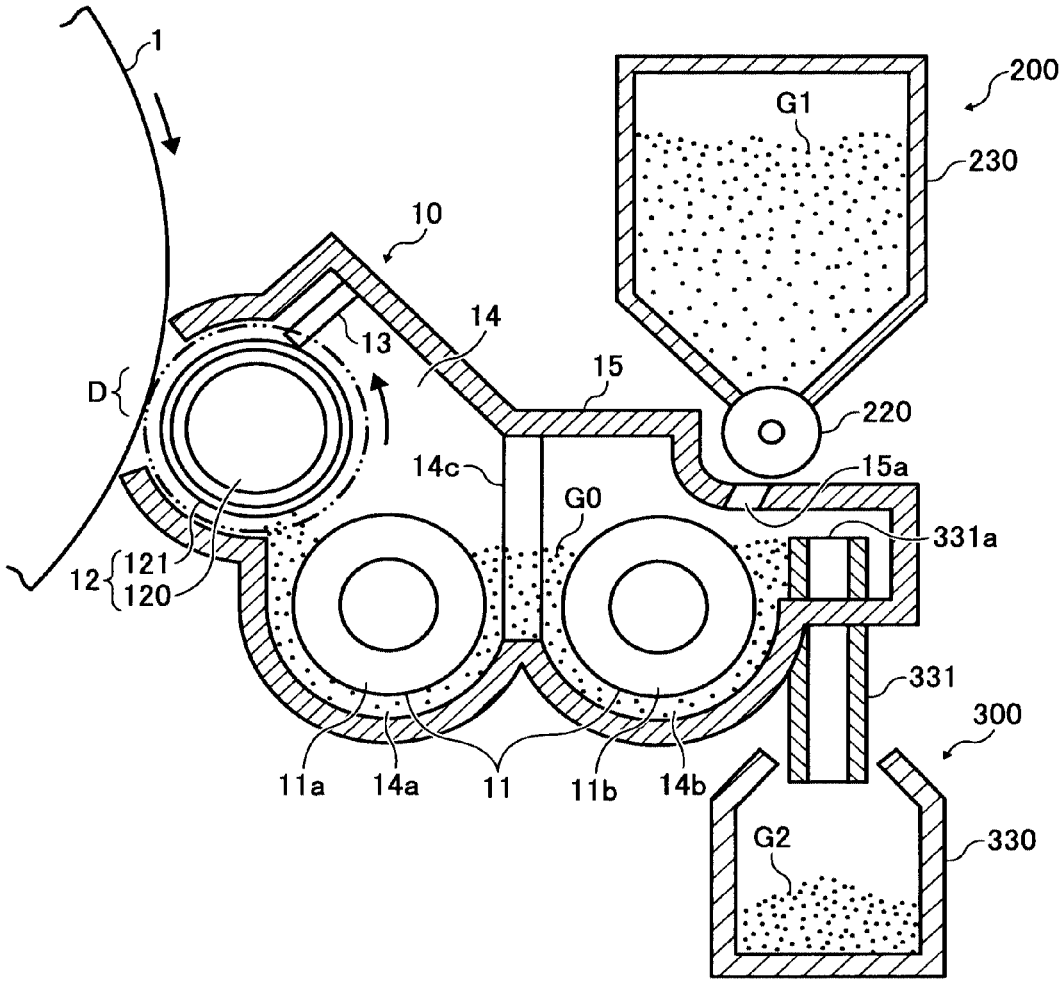
FIG. 3 is a schematic view illustrating a periphery of an embodiment of the image developer for use in the present invention.

Developer feeders 200A, 200B, 200C and 200D are located above the image forming units 2A, 2B, 2C and 2D, respectively. The developer feeder 200 feeds a new toner different from a toner fed to the photoreceptor 1 and a new carrier to the image developer 10, the constitution of which is shown in FIGS. 2 and 3.

An irradiator 6 is located below the image forming units 2A, 2B, 2C and 2D as a writing unit.

The irradiator 6 includes four LD light sources for each color, a polygon scanner including a polygon mirror and a polygon motor, and lenses and mirrors located in each light path, such as fθ lens and long cylindrical lens. A laser beam emitted from the LD is deflected and scanned with the polygon scanner to be irradiated onto the photoreceptor 1.

A fixer 9 fixing a transferred image on a transfer paper is located between the transfer belt 8 and the developer feeder 200. A paper discharge route 51 is formed downstream of the feeding direction of the transfer paper, and a pair of paper discharge rollers 52 discharge the transfer paper fed through the paper discharge route 51 onto paper tray 53.

The image forming apparatus 100 has a paper feeding cassette 7 at the bottom.

Next, the image forming operation of the image forming apparatus 100 will be explained. When the image forming operation starts, each of the photoreceptors rotates in clockwise direction in FIG. 1. The surface of each of the photoreceptors 1*a*, 1*b*, 1*c* and 1*d* is uniformly charged with a charging roller 301 of a charging unit 3. The irradiator 6 irradiates a laser beam including magenta image data to a photoreceptor 1*a* in the image forming unit 2A, a laser beam including cyan image data to a photoreceptor 1*b* in the image forming unit 2B, a laser beam including yellow image data to a photoreceptor 1*c* in the image forming unit 2C and a laser beam including black image data to a photoreceptor 1*d* in the image forming unit 2D to form a latent image including each of the color image data on each of the photoreceptors. When each of the latent images reaches the image developers 10A, 10B, 10C and 10D as the photoreceptor rotates, it is developed with each magenta, cyan, yellow and black color toner to form four colored toner images.

On the other hand, a transfer paper is fed by a separation paper feeder from the paper feeding cassette 7 and transported by a pair of registration rollers 55 located right before the transfer belt 8 such that the toner image formed on each of the photoreceptors 1 is transferred onto the transfer paper. The transfer paper is positively charged by a paper suction roller 52 located close to an entrance of the transfer belt 8 and is electrostatically suctioned to the surface thereof. Then, each magenta, cyan, yellow and black color toner image is sequentially transferred onto the transfer paper suctioned to the transfer belt 8 to form a full-color toner image the four magenta, cyan, yellow and black color toner images are overlapped. The fixer 9 melts and fixes the toner image on the transfer paper upon application of heat and pressure, and then the transfer paper passes through the paper discharge route and is discharged onto the paper tray 53 on the image forming apparatus 100.

FIG. 2 is a schematic view illustrating the developer feeding device for use in the present invention, and FIG. 3 is a schematic view illustrating a periphery of an embodiment of the image developer for use in the present invention. In FIG.

2, the developer feeder includes a developer container 230 containing a supplemental developer, a developer feeding device 220 feeding the supplemental developer in the developer container 230 into a sub-hopper 14 and a feed screw 223 feeding the supplemental developer from the sub-hopper 14 into an image developer 10. The developer feeding device 220 includes a flexible feed tube 240 feeding a developer or a toner from the developer container 230, a mohno pump 260 connected to the feed tube 240, a motor 226 driving the mohno pump 260 and a mohno electromagnetic clutch 227 transmitting a drive power of the motor 226 to the mohno pump 260 when necessary. A toner (developer) sensor 224 is located in the feed tube 240, and a toner end sensor 225 monitoring whether a developer or a toner is fed from an exit of the mohno pump 260 to the sub-hopper 14 is located at the exit of the mohno pump 260.

In FIG. 3, a developer feeding device 220 feeding a developer including a new toner and a new carrier new into an image developer 10 is located above the image developer 10. A developer collector 300 collecting the excessive developer in the image developer 10 is located below the image developer 10.

The image developer 10 mainly includes a housing 15 having a developer container 14 containing a two-component developer including a toner and a carrier, a developing roller 12 as a developer bearer rotating close to a photoreceptor 1 as an image bearer at an opening of the a housing 15, 2 feed screws 11*a* and 11*b* as developer stirring feeders rotating in the developer container 14, and a layer thickness regulator 13 contacting upon application of pressure or close to the developing roller 12.

The developing roller 12 is a rotating cylindrical sleeve 121 including a fixed magnet roll 120. The developer container 14 is divided by a division wall 14*c* into 2containing spaces 14*a* and 14*b* communicated each other, in which the feed screws 11*a* and 11*b* circulating the developer between the containing spaces 14*a* and 14*b*. The layer thickness regulator 13 has a double structure formed of non-magnetic member and a magnetic member having a polarity opposite to that of the magnet roll 120.

The developer collector 300 includes a collection container 330 collecting the excessive developer in the developer container 14 and a collection pipe 331 as a developer collection means transferring the excessive developer in the developer container 14 to the collection container 330. The collection pipe 331 has a top opening 331*a* at a predetermined height in the developer container 14 and the developer surpassing the top opening 331*a* is collected in the collection container 330.

The developer collector 300 of the present invention is not limited to the above, and may have a developer outlet at a place of the housing 15 and a transferer instead of the collection pipe 331 such as a collection screw close to a developer inlet of the collection container 330 to transfer the developer discharged from the developer outlet.

The collection pipe 331 may have the collection screw at the end or inside.

The development is performed in the image developer as follows.

First, after the two-component developer contained in the developer container 14 is stirred and fully mixed by the feed screws 11*a* and 11*b* to be frictionally charged, the developer is fed to the developing roller 12 and adheres to the surface of the sleeve 121 in the shape of a layer.

After the layer-shaped developer is regulated by the layer thickness regulator 13 to have a uniform thickness, the developer is transferred to a developing area D facing the photoreceptor 1 with the rotation of the sleeve 121. In the developing area D, the toner of the two-component developer is electrostatically absorbed to a latent image formed on the photoreceptor 1 in accordance with an original image to form a toner image on the photoreceptor 1.

The toner image the photoreceptor 1 is transferred and fixed on a transfer material as a recording paper.

Repetition of the development decreases the toner included in the developer in the developer container 14. When a toner concentration sensor detects the decrease of the toner, the developer feeding device 220 of the developer feeder 200 is driven to feed the two-component developer contained in the developer container 230 into the image developer 10. The two-component developer is stirred by the feed screws 11*a* and 11*b* in the developer container 14 to be fully mixed with the two-component developer contained therein before the two-component developer is fed from the developer container 230.

Both of the toner and carrier are fed from the developer feeder 200 in the developer container 14, and the developer gradually becomes superfluous therein. The excessive two-component developer in the developer container 14 overflows through the collection pipe 331 of the developer collector 300 when exceeding a limited height of the developer container 14 and is contained in the collection container 330.

In the image developer 10, although most of the deteriorated carrier is collected by the developer collector 300, a part of the carrier possibly remains in the developer container 14 for long periods. When the toner is consumed less, the carrier exchanges less and occasionally stays longer in the developer container 14.

When the toner and carrier are mixed by the feed screws 11*a* and 11*b* in the developer container 14, the toner and carrier, or carriers contact each other and the coating of the carrier is likely to be scraped.

When the coating of the carrier is noticeably scraped, the chargeability thereof to the toner deteriorates, resulting in unstable developability of the toner.

Figure 6:
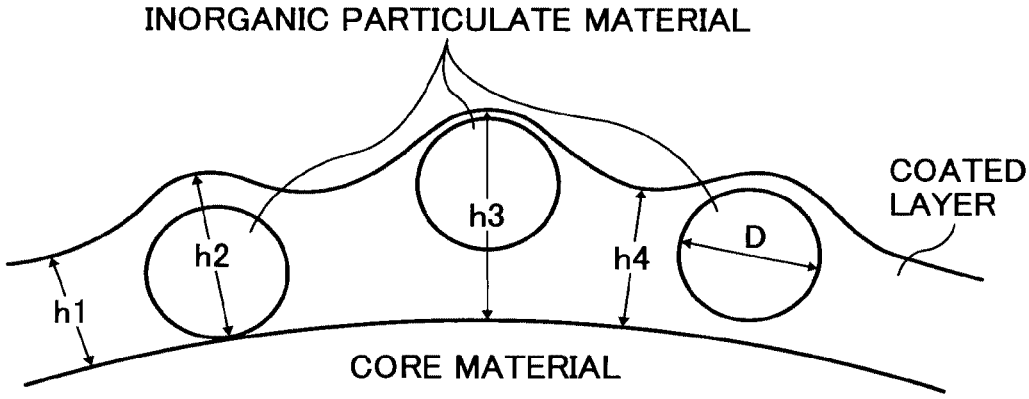
FIG. 6 is a schematic view illustrating a coated layer of the carrier of the present invention.

In the present invention, the carrier contained in the developer container 14 includes a core material and a layer coated on the surface of the core material, and the layer includes an inorganic particulate material as shown in FIG. 6.

The layer is partially convexed by the inorganic particulate material, and the convexes absorb shocks of the contact with the toners and the other carriers. Therefore, the convexes largely prevent the coating of the carrier from being scraped. In addition, the inorganic particulate material scrapes a toner adhering to the surface of the carrier (spent carrier) when stirred.

When the coating of the carrier is noticeably scraped or the toner noticeably adheres to the surface of the carrier, the electric resistivity of the carrier and the charge quantity of the developer deteriorate, resulting in unstable developability of the toner.

Further, when the electric resistivity of the carrier deteriorates, the carrier is likely to adhere to solid images, resulting deterioration of image definition. When the developer in the developer container 14 decreases, the image quality and durability deteriorate.

The carrier for use in the image forming apparatus of the present invention will be explained in detail later.

The developer feeding device 220 will be explained in detail, referring to the drawing. FIG. 2 is a schematic view illustrating the developer feeding device for use in the present invention.

The developer container 230 of the developer feeding device 220 is a cylindrical container having a spiral supplemental developer guide race on the inner circumferential surface thereof. New toner and carrier fed into the developer container 14 of the image developer 10 are contained in the developer container 230. In FIG. 2, the developer container 230 is detachably installed in the developer feeding device 220 equipped with a container holder holding the developer container 230 with an opening thereof toward the supplemental developer inlet and a driver rotating the developer container 230 around a central axis thereof.

Figure 4:
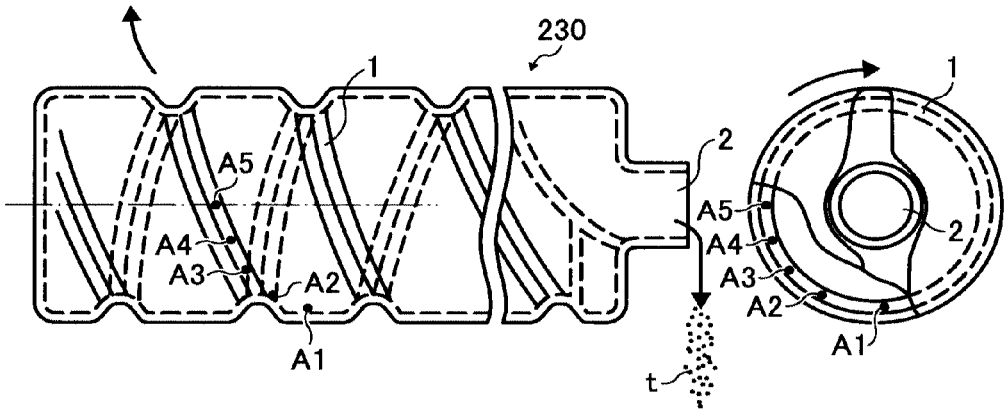
FIG. 4 is a schematic view illustrating a cross-section of the supplemental developer container for use in the present invention.

As shown in FIG. 4, when the developer container 230 is rotated in the direction of an arrow, a point A5 on the inner circumferential surface thereof constantly rotates around the central axis thereof. When a supplemental developer (t) is placed on the point A5, the supplemental developer (t) transfers to an outlet 2 through points A4, A3, A2 and A1 along a convex spiral (1) from A5 with the rotation of the developer container 230.

However, even in the developer container 230 having a convex spiral on the inner circumferential surface thereof, the carrier is eccentrically located therein due to a difference between specific gravities of the toner and the carrier. In addition, recent toners having smaller particle diameters, including waxes or being spheronized tend to adhere to toners or carriers, and the carriers are difficult to disperse in the toners.

In FIG. 3, the developer feeding device 220 includes the sub-hopper 14 of FIG. 2 (not shown in FIG. 3) connected to a feeding port 15*a* of the housing 15, the feed tube 240 of FIG. 2 (not shown in FIG. 3) and the mohno pump 260 of FIG. 2 connected to the feed tube 240. The developer feeding device 220 feeds a suitable amount of the developer from the developer container 230 to the sub-hopper 14 in accordance with a signal detected by a toner concentration sensor (not shown) in the developer container 14.

The feed tube 240 is preferably formed of a flexible rubber material such as polyurethane, nitrile and EPDM suitable for toners.

Figure 5:
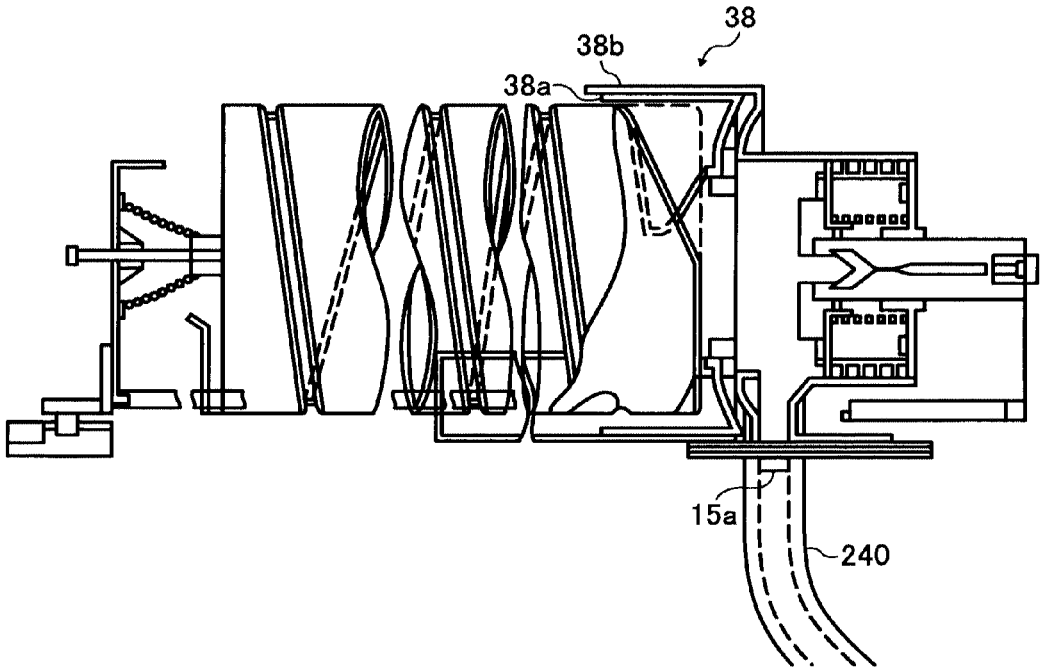
FIG. 5 is a schematic view illustrating a cross-section of the supplemental developer container set in the developer feeder.

FIG. 5 is a schematic view illustrating a cross-section of the supplemental developer container set in the developer feeder. The developer feeding device 220 has a housing 38 holding the developer container 230. The housing 38 is formed of a rigid material such as a resin, and has a double tube structure having an outer tube 38*b* including an inner tube 38*a*. The inner tube 38*a* and outer tube 38*b* includes a developer channel 23 for discharging the developer in the developer container 230. The developer in the developer container 230 is aspirated by the mohno pump 260 into the sub-hopper 14 through the feed tube 240.

The feed screw 223 in FIG. 2 has a spirally-twisted circular cross section and is formed of a hard material. The feed screw 223 is connected to the drive motor 226 for rotating the feed screw 223 through the electromagnetic clutch 227.

The developer enters the sub-hopper 14 through the feed tube 240 from the developer container 230, and is fed into the image developer 10 with the rotation of the feed screw 223.

Next, the operation of the developer feeding device 220 will be explained, referring to FIG. 2.

The developer feeding device starts feeding the developer when receiving a signal saying the toner concentration is short from the image developer 10. First, the developer container 230 rotates, the mohno pump drives to absorb the developer through the feed tube 240 into the sub-hopper 14.

The developer fed from the developer container 230 is stirred to include much air and fluidized more. When stirred, the eccentric localization of the toner and carrier is dispersed to some extent. When the toner and carrier are fed while eccentrically located, an excessive supply (flashing) of the toner occurs, but the absorption prevents the toner from scattering. The developer is fed from the sub-hopper 14 to the image developer 10 when receiving a signal saying the toner concentration is short therefrom. The toner is fine-tuned and stably fed through the sub-hopper 14. The feed screw 223 further disperses the eccentric localization of the toner and carrier before fed into the image developer 10.

When the carrier has a smaller true specific gravity, the toner and carrier is less eccentrically located and influence the image density less. When the true specific gravity is greater than 4 g/cm$^3$, the toner and carrier are fed into the image developer while eccentrically located without the sub-hopper. When the amount of the developer in a developer tank increases, e.g., when the toner concentration is controlled by detecting a magnetic permeability, the developer fed per unit of time a magnetic permeability sensor detects increases. The density of the developer at the detection surface increases and the magnetic permeability sensor indicates a high magnetic permeability. Therefore, the supplemental developer is further fed to maintain an initial standard, resulting in feeding of the developer having a toner concentration higher than the standard. On the contrary, when the amount of the developer therein decreases, the developer having a toner concentration lower than the standard is fed. Thus, the image density varies. In addition, when the eccentrically located toner and carrier are fed into the image developer, an excessive supply (flashing) thereof occurs, resulting in scattering of the toner from feeding route thereof.

When a two-component developer including a toner and a carrier is contained in the developer container 230, the carrier preferably has a ratio to the toner of from 3 to 20% by weight in the present invention.

When less than 3% by weight, the carrier is too short to sufficiently charge the toner in the image developer 10. When greater than 20% by weight, the carriers aggregate each other, resulting in unstable feeding of the developer to the image developer 10.

Next, the two-component developer including a toner and a carrier for use in the present invention will be explained.

The carrier of the present invention includes a core material, a layer coated on the core material and other optional layers.

The layer coated on the core material includes a binder resin, an inorganic particulate material and other optional components.

The inorganic particulate material included in the layer has a coverage not less than 70% to the core material in the present invention. The inorganic particulate material is included therein because of absorbing shocks of contacting toners or other carriers. This can prevent the toner from adhering to the carrier. When two or more inorganic particulate materials are used for adjusting resistivity and chargeability, etc., the coverage of the inorganic particulate material having a larger particle diameter matters.

The coverage of the particulate material is a coverage to the core material, and determined by the following formula:

$$(Ds\times\rho s\times W)/(4\times Df\times\rho f)\times 100$$

wherein Ds is an average particle diameter of the core material, ρs is a true specific gravity thereof, W is a weight ratio of the particulate material to the core material, Df is an average particle diameter of the particulate material and ρf is a true specific gravity thereof.

The true specific gravity of the core material ρs and true specific gravity of the particulate material are measured by a dry automatic bulk density meter ACUPIC 1330 from Shimadzu Corporation. This is a helium gas replacement method. 4 g of a sample is placed in a stainless cell having an inner diameter of 18.5 mm, a length of 39.5 mm and a capacity of 10 $cm^3$. Next, the volume of the sample in the cell is measured with a pressure variation of helium, and the density of the sample with the volume and weight of the sample. The volume-average particle diameter of the core material Ds is measured by a Microtrac particle diameter analyzer SRA type from NIKKISO CO., LTD. The range is from 0.7 to 125 μm. The dispersion liquid is methanol having a refractive index of 1.33, and those of the carrier and core material are set at 2.42. The average particle diameter (Df) of the inorganic particulate material is measured as follows:

placing 30 ml of amino silane (SH6020 from Dow Corning Toray Silicone Co., Ltd.) and 300 ml of toluene in a juicer-mixer; placing 6.0 g of a sample therein;

dispersing the mixture in the juicer-mixer at a low speed to prepare a dispersion;

placing the dispersion in 500 ml of toluene in a beaker having a capacity of 1,000 ml to be diluted to prepare a dilution; and measuring the volume-average particle diameter of the sample by an automatic particle diameter distribution measurer CAPA-700 from Horiba, Ltd. while stirring the dilution constantly by a homogenizer under the following conditions:

rotation speed: 2,000 rpm maximum particle diameter: 2.0 μm minimum particle diameter: 0.1 μm particle diameter interval: 0.1 μm dispersion medium viscosity: 0.59 mPa·s dispersion medium density: 0.87 g/$CM^3$ particle density: the density of the inorganic particulate material is an absolute specific gravity measured by a dry automatic bulk density meter ACUPIC 1330 from Shimadzu Corporation.

When the coverage is less than 70%, the core material is possibly exposed and the resistivity of the carrier locally deteriorates occasionally, causing white spots in the resultant images.

The carrier of the present invention preferably satisfies the following relationship:

$$0.5<D/h<1.5$$

wherein D represents a particle diameter of the particulate material included in the layer coated on the core material and h represents a thickness of the layer. The layer is partially convexed by the inorganic particulate material, and the convexes absorb shocks of the contact with the toners and the other carriers. The convexes also prevents the layer from being scraped and prevents the toner from adhering to the carrier. When D/h is 0.5 or less, the inorganic particulate material is buried in the binder resin. When 1.5 or more, the inorganic particulate material is likely to leave from the binder resin. When two or more inorganic particulate materials are used for adjusting resistivity and chargeability, etc., D of the inorganic particulate material having a larger particle diameter matters.

As shown in FIG. 6, h is a thickness from the surface of the core material to the surface of the layer. The thickness h is measured by observing the cross-section thereof with a transmission electron microscope (TEM). Specifically, h is an average thickness of 50 points having intervals of 0.2 μm along the surface of the carrier.

Specific examples of the inorganic particulate material include aluminum oxide, titanium dioxide, zinc oxide, silicon dioxide, barium sulfate, zirconium oxide and indium oxide. These can be used alone or in combination. In addition, a surface-treated inorganic particulate material with zirconium oxide, etc. can be used. The inorganic particulate material needs to be neither black nor colored in order to avoid color contamination when left from the binder resin. D is measured by the ultracentrifugal automatic particle diameter distribution measurer CAPA-700 from Horiba, Ltd.

The carrier of the present invention preferably has a volume resistivity of from 10 [Log(Ω·cm)] to 16 [Log(Ω·cm)]. When less than 10 [Log(Ω·cm)], the carrier tends to adhere to non-image areas. When greater than [Log(Ω·cm)], the edge effect deteriorates. When less than the minimum resistivity measurable by a high resist meter, the carrier substantially has no volume resistivity and is considered to be broken down.

Figure 7:
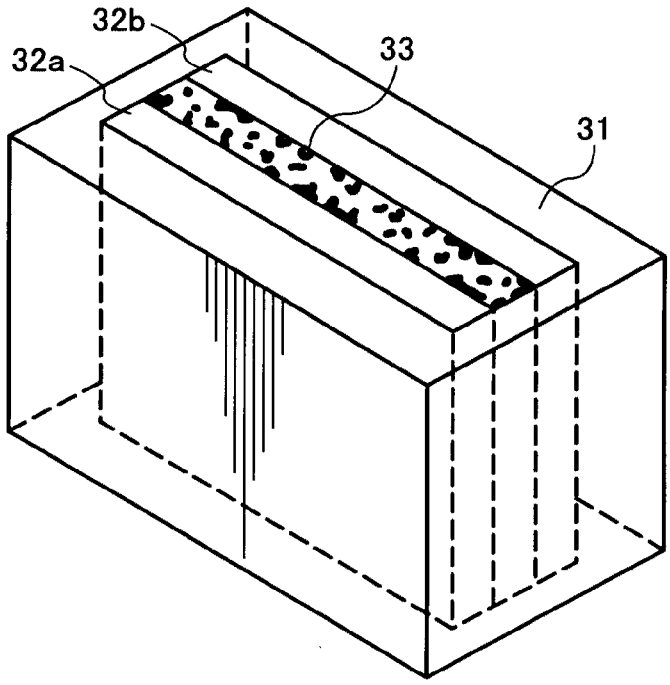
FIG. 7 is a schematic view illustrating an apparatus used for measuring a volume resistivity of a carrier.

The volume resistivity is measured as follows:

filling a carrier 33 in a cell 31 formed of a fluorine-containing resin containing electric poles 32 and **32*b* having a surface area of 2 cm×4 cm respectively and a gap of 2 mm therebetween as shown in FIG. 7**;

tapping the cell 31 by a tapping machine PTM-1 from SANKYO PIO-TECH. CO., Ltd. at 30 times/min for 1 min;

applying a DC voltage of 1,000V between the electric poles; and measuring a DC resistance by a high resistance meter 4329A from YOKOKAWA HEWLETT PACKARD LTD to determine an electric resistance R Ω·cm and Log R.

The carrier of the present invention preferably has a volume-average particle diameter of from 20 to 65 μm. When less than 20 μm, the carrier deteriorates in uniformity and tends to have adherence thereof. When larger than 65 μm, reproducibility of image details deteriorates and high-definition images are hard to produce. The volume-average particle diameter of a carrier can be measured by SRA type of MICROTRAC particle size analyzer measuring a range of from 0.7 to 125 μm from NIKKISO CO., LTD., wherein methanol is used as a dispersion liquid and a refractive index thereof is set at 1.33 and those of the carrier and core material are set at 2.42.

The binder resin is preferably a silicone resin. Having a low surface energy, the silicone resin can prevent a toner from sticking.

Specific examples of the silicone resin include any known silicone resins such as straight silicones and silicones modified with a resin such as an alkyd resin, a polyester resin, an epoxy resin, an acrylic resin and a urethane resin. Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), ES1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

The binder resin preferably includes an acrylic resin. Having strong adhesiveness and low brittleness, the acrylic resin stably maintains the coated film, preventing the coated film from being abraded and separating. Further, the particulate material included therein is strongly maintained, particularly when having a particle diameter larger than the average thickness thereof. Specific examples of the acrylic resin include known acrylic resins. The acrylic resin can be used alone, and a combination with at least one other constituent crosslinking therewith can also be used. Specific examples of the other constituent crosslinking therewith include amino resins such as guanamine and a melamine resin; and acidic catalysts.

Specific examples of the acidic catalysts include any materials having a catalytic influence, e.g., materials having a reactive group such as a complete alkyl group, a methylol group, an imino group and a methylol/imino group. The binder resin preferably includes an acrylic resin and a silicone resin. Since the acrylic resin has a high surface energy, a toner tends to stick to the carrier and accumulate thereon, resulting in deterioration of charge quantity thereof. The silicone resin having a low surface energy solves this problem when used with the acrylic resin. It is important to balance the properties of the two resins because the silicone resin has low adhesiveness and high brittleness. Then, a toner is difficult to stick to the coated film, and which has good abrasion resistance. When the silicone resin and acrylic resin are combined, the binder resin preferably includes the silicone resin or the acrylic resin in an amount of from 5 to 95% by weight, and more preferably from 10 to 90% by weight.

The carrier of the present invention preferably has a magnetization of from 40 $Am^2/kg$ to 90 $Am^2/kg$ at 1,000 Oe, when gaps between the carriers are suitably maintained and a toner is smoothly dispersed with the carrier in a developer. When less than 40 $Am^2/kg$ at 1,000 Oe, the carrier adherence tends to occur. When greater than 90 $Am^2/kg$, an ear (magnetic brush) of the developer when developing becomes hard, resulting in deterioration of reproducibility of image details. The magnetization can be measured as follows:

placing 1.0 g of the carrier core material in a cylindrical cell having an inner diameter of 7 mm and a height of 10 mm;

setting the cell in a B-H tracer BHU-60 from Riken Denshi Co., Ltd.;

increasing a (first) magnetic field gradually to 3,000 Oe and decreasing the magnetic field gradually to 0; increasing an opposite magnetic field gradually to 3,000 Oe and decreasing the magnetic field gradually to 0; and applying a magnetic field again to the same direction of the (first) magnetic field to prepare a B-H curve, from which the magnetization at 1,000 Oe is determined.

The layer coated on the core material is formed by, e.g., a following method:

dissolving the inorganic particulate material, a binder resin, etc. in a solvent to prepare a coating liquid;

uniformly coating the liquid on the surface of the core material by conventional coating methods; and drying the liquid and burning the dried liquid into the surface thereof.

The coating methods include dip coating methods, spray coating methods, etc.

The solvents include, but are not limited to, toluene, xylene, methylethylketone, methylisobutylketone, butylcellosolveacetate, etc.

The burning methods include, but are not limited to, outer burning methods or inner burning methods using a fixed electric oven, a fluidized electric oven, a rotary electric oven, a burner furnace, a microwave, etc.

The core material preferably has a volume-average particle diameter of from 20 to 65 μm. When less than 20 μm, the carrier tends to adhere to an electrostatic latent image bearer. When larger than 65 μm, deterioration of image quality such as a carrier stripe tends to occur. Particularly, the core material more preferably has a volume-average particle diameter of from 25 to 50 μm for higher quality images.

The core material of the present invention includes known materials, and is not particularly limited, such as ferrite, Cu—Zn-ferrite, Mn ferrite, Mn—Mg-ferrite, Mn-MG-Sr ferrite, magnetite iron and nickel. Suitable materials can be selected in accordance with the applications of the carrier.

The developer of the present invention includes the carrier and a toner.

The toner includes at least a binder resin and a colorant, and optionally other components such as a release agent and a charge controlling agent. The developer includes the toner in an amount of from 1 to 10.0 parts by weight per 100 parts by weigh of the carrier.

The toner includes known toners such as a monochrome toner and a color toner prepared by pulverization methods and polymerization methods. The toner includes a binder resin and a colorant, and may be an oilless toner further including a release agent. The release agent of the oilless toner typically tends to transfer to the surface of the carrier, however, the carrier of the present invention well avoids this and maintains its good quality. Particularly, an oilless color toner has more of this tendency because of occasionally including a binder resin having a low glass transition temperature, however, the carrier of the present invention solves this problem.

Specific examples of the binder resin include any known resins such as homopolymers of styrene and its derivatives such as polystyrene, poly-p-chlorostyrene and polyvinyltoluene; copolymers of styrene such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylic acid copolymer, a styrene-methyl methacrylate copolymer, a styrene-ethyl methacrylate copolymer, a styrene-butyl methacrylate copolymer, a styrene-α-chloro methyl methacrylate copolymer, a styrene-acrylonitrile copolymer, styrene-vinyl methyl ether copolymer, a styrene-vinyl methyl ketone copolymer, a styrene-butadiene copolymer, styrene-isoprene copolymer, a styrene-maleate copolymer; a polymethyl methacrylate resin, a polybutyl methacrylate resin, a polyvinylchloride resin, a polyethylene resin, a polyester resin, a polyurethane resin, an epoxy resin, a polyvinylbutyral resin, a polyacrylic acid resin, a rosin resin, a modified rosin resin, a terpene resin, a phenol resin, an aliphatic or aromatic hydrocarbon resin, an aromatic petroleum resin, etc. These can be used alone or in combination.

In addition, known binder resins for pressure fixation can also be used. Specific examples thereof include, but are not limited to, low-molecular-weight polyethylene, polyolefin such as low-molecular-weight polypropylene, an ethylene-acrylic acid copolymer, an ethylene-acrylic acid ester copolymer, a styrene-methacrylic acid copolymer, an ethylene-methacrylic acid ester copolymer, an ethylene-vinylchloride copolymer, an ethylene-vinylacetate copolymer, an olefin copolymer such as an ionomer resin, an epoxy resin, a polyester resin, a styrene-butadiene copolymer, polyvinylpyrrolidone, methylvinylether-maleic acid anhydride, a maleic-acid-modified phenol resin, a phenol-modified terpene resin, etc. These can be used alone or in combination.

The toner for use in the present invention may include a fixing aid besides the binder resin, colorant and optional charge controlling agent. Such a toner can be used in an oilless fixing system wherein an oil preventing the toner from sticking to a fixing roll is not applied thereto. Known fixing aids, e.g., polyolefins such as polyethylene and polypropylene, fatty acid metallic salts, fatty acid esters, paraffin waxes, amide waxes, multivalent alcohols, silicone varnishes, carnauba waxes, ester waxes, etc. can be used, but are not limited thereto.

Known pigments or dyes capable of preparing a yellow, a magenta, a cyan and a black toner can be used as the colorant, but are not limited to the following ones. Specific examples of the yellow pigments include cadmium yellow, Pigment Yellow 155, benzimidazolone, Mineral Fast Yellow, Nickel Titan Yellow, naples yellow, Naphthol Yellow S, Hansa Yellow G, Hansa Yellow 10G, Benzidine Yellow GR, Quinoline Yellow Lake, Permanent Yellow NCG, Tartrazine Lake, etc.

Specific examples of the orange color pigments include Molybdenum Orange, Permanent Orange GTR, Pyrazolone Orange, Vulcan Orange G, Indanthrene Brilliant Orange GK, etc.

Specific examples of the red pigments include red iron oxide, quinacridone red, cadmium red, Permanent Red 4R, Lithol Red, Pyrazolone Red, Watching Red calcium salts, Lake Red D, Brilliant Carmine 6B, Eosine Lake, Rhodamine Lake B, Alizarine Lake, Brilliant Carmine 3B, etc.

Specific examples of the violet pigments include Fast Violet B, Methyl Violet Lake, etc.

Specific examples of the blue pigments include cobalt blue, Alkali Blue, Victoria Blue Lake, Phthalocyanine Blue, metal-free Phthalocyanine Blue, partially chlorinated Phthalocyanine Blue, Fast Sky Blue, Indanthrene Blue BC, etc.

Specific examples of the green pigments include a chrome green, chrome oxide, Pigment Green B, Malachite Green Lake, etc.

Specific examples of the black pigments include azine pigments such as carbon black, oil furnace black, channel black, lamp black, acetylene black and aniline black, metal salts of azo pigments, metal oxides, complex metal oxides, etc.

These pigments are used alone or in combination.

Specific examples of the charge controlling agents include Nigrosin; azine dyes including an alkyl group having 2 to 16 carbon atoms disclosed in Japanese Patent Publication No. 42-1627; basic dyes (e.g. C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), Basic Blue 26 (C.I. 44045), C.I. Basic Green 1 (C.I. 42040) and C.I. Basic Green 4 (C.I. 42000)); lake pigments of these basic dyes; C.I. Solvent Black 8 (C.I. 26150); quaternary ammonium salts such as benzoylhexadecylammonium chlorides and decyltrimethyl chlorides; dialkyl tin compounds such as dibuthyl ordioctyl tin compounds; dialkyl tin borate compounds; guanidine derivatives; vinyl polymers including amino groups, polyamine resins such as condensation polymers including an amino group, metal complexes of mono azo dyes disclosed in Japanese Patent Publications Nos. 41-20153, 43-27596, 44-6397 and 45-26478; metal complexes of dicarboxylic acid such as Zn, Al, Co, Cr, and Fe complexes of salicylic acid, dialkylsalicyic acid and naphtoic acid; sulfonated copper phthalocyanine pigments, organic boric salts, quaternary ammonium salts including a fluorine atom, calixarene compounds, etc. For a color toner besides a black toner, a charge controlling agent impairing the original color should not be used, and white metallic salts of salicylic acid derivatives are preferably used.

The toner optionally includes an external additive. Specific examples thereof include inorganic particulate materials such as silica, titanium oxide, alumina, silicon carbonate, silicon nitride and boron nitride; and particulate resins. These are externally added to a parent toner to further improve transferability and durability thereof. This is because these external additives cover a release agent deteriorating the transferability and durability of a toner and the surface thereof to decrease contact area thereof. The inorganic particulate materials are preferably hydrophobized, and hydrophobized particulate metal oxides such as silica and titanium oxide are preferably used. The particulate resins such as polymethylmethacrylate and polystyrene fine particles having an average particle diameter of from 0.05 to 1 μm, which are formed by a soap-free emulsifying polymerization method, are preferably used. Further, a toner including the hydrophobized silica and hydrophobized titanium oxide as external additives, wherein an amount of the hydrophobized silica is larger than that of the hydrophobized titanium oxide, has good charge stability against humidity. A toner including and external additives having a particle diameter larger than that of conventional external additives, such as a silica having a specific surface area of from 20 to 50 $m^2/g$ and particulate resins having an average particle diameter of from 1/100 to 1/8 to that of the toner besides the inorganic particulate materials, has good durability. This is because the external additives having a particle diameter larger than that of the particulate metal oxides prevent the particulate metal oxides from being buried in a parent toner, although tending to be buried therein while the toner is mixed and stirred with a carrier, and charged in an image developer for development. A toner internally including the inorganic particulate materials and particulate resins improves pulverizability as well as transferability and durability although improving less than a toner externally including them. When the external and internal additives are used together, the burial of the external additives in a parent toner can be prevented and the resultant toner stably has good transferability and durability.

Specific examples of the hydrophobizer include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyltrichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used. Besides, as an external additive for the purpose of improving cleanability, lubricants such as a particulate fatty acid metal salt and polyvinylidene fluoride can be used.

The toner can be prepared by known methods such as a pulverization method and a polymerization method.

In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used. The melted and kneaded materials thereby are cooled and pulverized. A hammer mill, rotoplex, etc. crush the cooled materials, and jet stream and mechanical pulverizers pulverize the crushed materials to preferably have an average particle diameter of from 3 to 15 μm. Further, the pulverized materials are classified into the materials having particle diameters of from 5 to 20 μm by a wind-force classifier, etc. Next, an external additive is preferably added to a parent toner. The external additive and parent toner are mixed and stirred by a mixer such that the external additive covers the surface of the parent toner while pulverized. It is essential that the external additives such as inorganic particulate materials and particulate resins are uniformly and firmly fixed to the parent toner to improve durability of the resultant toner. This is simply an example and the method is not limited thereto.

The resistivity of the carrier for use in the present invention can be adjusted without including carbon black, and therefore the carrier can produce color images having high color reproducibility and high definition without color contamination due to the carbon black.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were dispersed with a homomixer at 15,000 rpm for 10 min to prepare a silicone-resin-containing layer coating liquid.

| | |
|---|---|
| Silicone resin solution (solid content of 20% by weight of SR2410 from Dow Corning Toray Silicone Co., Ltd.) | 352.0 |
| Aminosilane (solid content of 100% by weight of SH6020 from Dow Corning Toray Silicone Co., Ltd.) | 0.60 |
| Inorganic particulate material A Aluminum oxide AKP-30 from Sumitomo Chemical Co., Ltd., having a particle diameter of 0.40 μm and a true specific gravity of 3.9 g/cm$^3$ | 92.9 |
| Inorganic particulate material B Titanium oxide MT-150A from Tayca Corp., having a particle diameter of 0.15 μm | 25.8 |
| Toluene | 380 |

The coating liquid solution was coated and dried on 5,000 parts of a Cu—Zn ferrite powder F-300 from Powdertech Co., Ltd., having an average particle diameter of 55 μm and a true specific gravity of 5.2 g/cm$^3$ by SPIRA COTA from OKADA SEIKO CO., LTD. at a liquid flow rate of 40 g/min and an inner temperature of 40° C. such that the coated layer has a thickness of 0.40 μm. The resultant carrier material was calcined in an electric oven at 200° C. for 1 hr. After cooled, the carrier material was sieved through openings of 90 μm to prepare a carrier 1 having a D/h of 1.0, a volume resistivity of 14.9 [Log(Ω·cm)] and a magnetization of 65 Am$^2$/kg. The inorganic oxidized particulate material included in the layer had a coverage of 85% to the core material.

The average particle diameter of the core material was measured by Microtrac particle diameter analyzer SRA type from NIKKISO CO., LTD. at a measurement range of from 0.7 to 125 μm.

724 parts of an adduct of bisphenol A with 2 moles of ethyleneoxide, 276 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 32 parts of phthalic acid anhydride were added thereto and reacted for 2 hrs at 160° C. Next, the mixture was reacted with 188 parts of isophoronediisocyanate in ethyl acetate for 2 hrs at 80° C. to prepare a prepolymer including isocyanate. Next, 267 parts of the prepolymer and 14 parts of isophoronediamine were mixed for 2 hrs at 50° C. to prepare a urea-modified polyester resin having a weigh-average molecular weight of 64,000. Similarly, 724 parts of an adduct of bisphenol A with 2 moles of ethyleneoxide and 276 parts of terephthalic acid were polycondensated for 8 hrs at a normal pressure and 230° C., and further, after the mixture was depressurized by 10 to 15 mm Hg and reacted for 5 hrs to prepare a unmodified polyester resin having a peak molecular weight of 5,000. 200 parts of the urea-modified polyester and 800 parts of the unmodified polyester resin were dissolved and mixed in 2,000 parts of a mixed solvent formed of ethyl acetate and MEK to prepare a binder resin ethyl acetate/MEK solution. The binder resin ethyl acetate/MEK solution was partially depressurized and dried to isolate the binder resin. The toner binder resin had a glass transition temperature (Tg) of 62° C.

240 parts of the binder resin ethyl acetate/MEK solution, 20 parts of pentaerythritoltetrabehenate having a melting point of 81° C. and a melting viscosity of 25 cps and 4 parts of C.I. Pigment Yellow 154 were uniformly dissolved and dispersed with TK-HOMOMIXER at 12,000 rpm and 60° C. in a beaker to prepare a toner constituents solution. 706 parts of ion-exchanged water, 294 parts of hydroxyapatite suspension liquid having a concentration of 10% (Supertite 10 from Nippon Chemical Industrial Co., Ltd.) and 0.2 parts of sodium dodecylbenzenesulfonate were uniformly dissolved in a beaker to prepare a solution. The solution was heated to have a temperature of 60° C. and the toner constituents liquid was put therein while stirred with TK-HOMOMIXER at 12,000 rpm for 10 min to prepare a liquid mixture. The liquid mixture was placed in a flask having a stirrer and a thermometer and heated to have a temperature of 98° C., and a solvent was removed therefrom to prepare a dispersion slurry. The dispersion slurry was depressurized and filtered to prepare a filtered cake.

(i) 100 parts of ion-exchanged water were added to the filtered cake, which was mixed with TK-HOMOMIXER at 12,000 rpm for 10 min and filtered.

(ii) 100 parts of sodium hydroxide solution having a concentration of 10% were added to the filtered cake of (i), which was mixed with TK-HOMOMIXER at 12,000 rpm for 30 min and filtered under reduced pressure.

(iii) 100 parts of hydrochloric acid having a concentration of 10% were added to the filtered cake of (ii), which was mixed with TK-HOMOMIXER at 12,000 rpm for 30 min and filtered.

(iv) 300 parts of ion-exchanged water were added to the filtered cake of (iii), which was mixed with TK-HOMOMIXER at 12,000 rpm for 10 min and filtered twice to prepare a filtered cake 1.

The filtered cake 1 was dried by an air drier at 45° C. for 48 hrs.

15 parts of the filtered cake 1 were added to 90 parts of water, in which 0.0005 parts of a fluorine compound were dispersed so as to adhere to the surface of toner particles. Next, the filtered cake the fluorine compound adheres on was dried by an air drier at 45° C. for 48 hrs, and sieved with a mesh having an opening of 75 μm to prepare toner particles.

As external additives, 1.5 parts of hydrophobic silica and 0.7 parts of hydrophobized titanium oxide were mixed with 100 parts of the toner particles by HENSCHEL MIXER at 2,000 rpm for 30 sec 5 times to prepare a toner 1.

5 parts of the toner 1 and 95 parts of the carrier 1 were mixed to prepare a developer having a toner concentration of 5% by weight. In addition, 90 parts of the toner 1 and 10 parts of the carrier 1 were filled in a developer container to prepare a supplemental developer. The properties of carriers (developers) prepared in each Example and Comparative Example are shown in Table 1. Color contamination, carrier adherence, image density and durability (charge quantity deterioration and resistivity variation) thereof were evaluated and the results are shown in Table 2.

The valuation methods and conditions will be explained.

[Color Contamination]

A yellow monochrome image was produced before and after 30,000 images having 0.5% image area were produced by digital full-color printer imagio MP C4500, and ΔE values thereof were determined by the following formula:

$$\Delta E=\sqrt{((\text{initial } L^*)^2+(\text{initial } a^*)^2+(\text{initial } b^*)^2)}-\sqrt{((\text{after } 30k\ L^*)^2+(\text{after } 30k\ a^*)^2+(\text{after } 30k\ b^*)^2)}$$

wherein each of L*, a* and b* is an average of CIE L*, CIE a* and CIE b* of 3 points having a image density of 1.4±0.5 when measured by X-RITE938 from X-Rite Corp.

○: ΔE is 2 or less, no color contamination

Δ: ΔE is more than 2 and less than 4, color contamination is not outstanding and color tone variation is not noticeable X: ΔE is 4 or more, outstanding color contamination and noticeable color tone variation

[Carrier Adherence]

The developer was set in a modified digital full-color printer imagio MP C4500, and a dot-formed halftone image was developed on the photoreceptor at a charged potential of DC 740 V and a developing bias of 600 V (a surface potential of 140 V). The number of the carriers adhering to the surface of the photoreceptor were counted with a loupe. An average of the number thereof in five 100 $cm^2$ spots was determined.

◎: 20 or less

○: from 21 to 60

Δ: from 61 to 80

X: 81 or more

◎, ○ and Δ are usable, and X is unusable

In addition, an A3 size solid image was produced while that the photoreceptor had a charged potential of DC 740 V and a developing bias was 600 V (a surface potential of 140 V) to count the number of white spots thereon.

◎: 5 or less

○: from 6 to 10

Δ: from 11 to 20

X: 21 or more

◎, ○ and Δ are usable, and X is unusable

[Image Density 1]

The developer was set in a modified digital full-color printer imagio MP C4500, and every 3,000 pieces of two monochrome images having an image area of 0.5% and that of 50% was alternately produced until 300,000 pieces thereof were totally produced. A solid image was produced on 6000 paper from Ricoh Company, Ltd. every time after 3,000 pieces of either of the two images were produced, and the image density thereof was measured by X-Rite from X-Rite Corp.

◎: ±0.15 or less

○: ±0.30 or less

Δ: ±0.40 or less

X: ±0.41 or more

The printer was modified to have a developer container having a spiral developer guide race on the inner circumferential surface thereof and a sub-hopper as shown in FIG. 4, wherein a supplemental developer is fed from the developer container into the sub-hopper. In addition, the printer was modified such that a suitable amount of the developer is fed to the image developer in accordance with a detection signal such as a toner concentration sensor.

[Durability 1]

The developer was set in a digital full-color printer imagio MP C4500 equally modified as in [Image density 1], and 300,000 pieces of a monochrome image having an image area of 50% were produced. Then, a charge loss of the developer was measured. In addition, 300,000 pieces of a monochrome image having an image area of 0.5% were produced. Then, a resistivity loss of the carrier was measured.

The charge loss is a difference (Q1−Q2) between a charge quantity Q1 of the initial carrier and a charge quantity Q2 of the carrier after 100,000 monochrome images were continuously produced, wherein the charge quantity Q2 was measured by separating 95 parts of the carrier from 5 parts of the toner with a blow-off apparatus TB-200 from Toshiba Chemical Co., Ltd. after 100,000 images were produced. The difference is preferably 10.0 μC/g or less.

The resistivity loss is an absolute value of a difference (|R1−R2|) between a resistivity loss R1 of the initial carrier and a resistivity loss R2 after 300,000 images were produced, wherein the resistivity loss R2 was measured by separating the carrier from the toner with a blow-off apparatus TB-200 from Toshiba Chemical Co., Ltd. after 300,000 images were produced. The difference is preferably 3.0 [Log(Ω·cm)] or less. The resistivity loss is caused by abrasion of the coated layer of the carrier, the toner adherence thereto and a separation of a particulate material from the coated film thereof. Therefore, the resistivity loss can be prevented when these are reduced.

Example 2

The procedure for preparation of the carrier 1 in Example 1 was repeated except for changing the coating liquid formulation for layer of the carrier to the following formulation to prepare a carrier 2 having a D/h of 1.1, a volume resistivity of 15.4 [Log(Ω·cm)] and a magnetization of 65 $Am^2/kg$. The inorganic oxidized particulate material included in the layer had a coverage of 98% to the core material.

| | |
|---|---|
| Acrylic resin solution (solid content of 50% by weight) | 49.7 |
| Guanamine solution (solid content of 70% by weight) | 14.1 |
| Acidic catalyst (solid content of 20% by weight) | 0.28 |
| Silicone resin solution (solid content of 20% by weight of SR2410 from Dow Corning Toray Silicone Co., Ltd.) | 176.1 |

-continued

| | |
|---|---|
| Aminosilane (solid content of 100% by weight of SH6020 from Dow Corning Toray Silicone Co., Ltd.) | 0.60 |
| Inorganic particulate material A Aluminum oxide AKP-30 from Sumitomo Chemical Co., Ltd., having a particle diameter of 0.40 μm and a true specific gravity of 3.9 g/cm$^3$ | 106.8 |
| Inorganic particulate material B Titanium oxide MT-150A from Tayca Corp., having a particle diameter of 0.15 μm | 25.8 |
| Toluene | 450 |

The carrier 2 and the toner 1 were mixed in the same way as in Example 1 to prepare a developer and a supplemental developer.

Example 3

The procedure for preparation of the carrier 1 in Example 1 was repeated except for excluding the inorganic particulate material A and inorganic particulate material B to prepare a carrier 3 having a volume resistivity of 15.8 [Log(Ω·cm)] and a magnetization of 66 Am$^2$/kg.

Example 4

The procedure for preparation of the carrier 1 in Example 1 was repeated except for changing the coating liquid formulation for layer of the carrier to the following formulation to prepare a carrier 4 having a D/h of 2.0, a volume resistivity of 13.1 [Log(Ω·cm)] and a magnetization of 66 Am$^2$/kg. The inorganic oxidized particulate material included in the layer had a coverage of 72% to the core material.

| | |
|---|---|
| Acrylic resin solution (solid content of 50% by weight) | 10.9 |
| Guanamine solution (solid content of 70% by weight) | 3.10 |
| Acidic catalyst (solid content of 20% by weight) | 0.06 |
| Silicone resin solution (solid content of 20% by weight of SR2410 from Dow Corning Toray Silicone Co., Ltd.) | 137.5 |
| Aminosilane (solid content of 100% by weight of SH6020 from Dow Corning Toray Silicone Co., Ltd.) | 0.30 |
| Inorganic particulate material A Aluminum oxide AKP-30 from Sumitomo Chemical Co., Ltd., having a particle diameter of 0.40 μm and a true specific gravity of 3.9 g/cm$^3$ | 78.5 |
| Inorganic particulate material B Titanium oxide MT-150A from Tayca Corp., having a particle diameter of 0.15 μm | 12.9 |
| Toluene | 200 |

The carrier 4 and the toner 1 were mixed in the same way as in Example 1 to prepare a developer and a supplemental developer.

Example 5

The procedure for preparation of the carrier 1 in Example 1 was repeated except for changing the coating liquid formulation for layer of the carrier to the following formulation to prepare a carrier 5 having a D/h of 0.4, a volume resistivity of 14.5 [Log(Ω·cm)] and a magnetization of 64 Am$^2$/kg. The inorganic oxidized particulate material included in the layer had a coverage of 107% to the core material.

| | |
|---|---|
| Acrylic resin solution (solid content of 50% by weight) | 36.8 |
| Guanamine solution (solid content of 70% by weight) | 10.5 |
| Acidic catalyst (solid content of 20% by weight) | 0.20 |
| Silicone resin solution (solid content of 20% by weight of SR2410 from Dow Corning Toray Silicone Co., Ltd.) | 464.2 |
| Aminosilane (solid content of 100% by weight of SH6020 from Dow Corning Toray Silicone Co., Ltd.) | 1.01 |
| Inorganic particulate material C Electroconductive alumina EC-700 from Titan Kogyo Co., Ltd., having a particle diameter of 0.42 μm and a true specific gravity of 3.7 g/cm$^3$ | 116.1 |
| Inorganic particulate material B Titanium oxide MT-150A from Tayca Corp., having a particle diameter of 0.15 μm | 43.5 |
| Toluene | 700 |

The carrier 5 and the toner 1 were mixed in the same way as in Example 1 to prepare a developer and a supplemental developer.

Example 6

The procedure for preparation of the carrier 1 in Example 1 was repeated except for changing the coating liquid formulation for layer of the carrier to the following formulation to prepare a carrier 6 having a D/h of 2.0, a volume resistivity of 13.1 [Log(Ω·cm)] and a magnetization of 66 Am$^2$/kg. The inorganic oxidized particulate material included in the layer had a coverage of 100% to the core material.

| | |
|---|---|
| Acrylic resin solution (solid content of 50% by weight) | 28.6 |
| Guanamine solution (solid content of 70% by weight) | 8.10 |
| Acidic catalyst (solid content of 20% by weight) | 0.16 |
| Silicone resin solution (solid content of 20% by weight of SR2410 from Dow Corning Toray Silicone Co., Ltd.) | 360.9 |
| Aminosilane (solid content of 100% by weight of SH6020 from Dow Corning Toray Silicone Co., Ltd.) | 0.79 |
| Inorganic particulate material A Aluminum oxide AKP-30 from Sumitomo Chemical Co., Ltd., having a particle diameter of 0.40 μm and a true specific gravity of 3.9 g/cm$^3$ | 109.1 |
| Inorganic particulate material B Titanium oxide MT-150A from Tayca Corp., having a particle diameter of 0.15 μm | 33.9 |
| Toluene | 550 |

The carrier 6 and the toner 1 were mixed in the same way as in Example 1 to prepare a developer and a supplemental developer.

Example 7

The procedure for preparation of the carrier 1 in Example 1 was repeated except for changing the coating liquid formulation for layer of the carrier to the following formulation to prepare a carrier 7 having a weight-average particle diameter of 18 μm, a true specific gravity of 5.7, a D/h of 0.9, a volume resistivity of 15.7 [Log(Ω·cm)] and a magnetization of 66 $Am^2/kg$. The inorganic oxidized particulate material included in the layer had a coverage of 71% to the core material.

| | |
|---|---|
| Acrylic resin solution (solid content of 50% by weight) | 68.4 |
| Guanamine solution (solid content of 70% by weight) | 19.4 |
| Acidic catalyst (solid content of 20% by weight) | 0.38 |
| Silicone resin solution (solid content of 20% by weight of SR2410 from Dow Corning Toray Silicone Co., Ltd.) | 864.4 |
| Aminosilane (solid content of 100% by weight of SH6020 from Dow Corning Toray Silicone Co., Ltd.) | 0.46 |
| Inorganic particulate material A Aluminum oxide AKP-30 from Sumitomo Chemical Co., Ltd., having a particle diameter of 0.40 μm and a true specific gravity of 3.9 $g/cm^3$ | 215 |
| Inorganic particulate material B Titanium oxide MT-150A from Tayca Corp., having a particle diameter of 0.15 μm | 33.9 |
| Toluene | 800 |

The carrier 7 and the toner 1 were mixed in the same way as in Example 1 to prepare a developer and a supplemental developer.

Example 8

The procedure for preparation of the carrier 1 in Example 1 was repeated except for changing the coating liquid formulation for layer of the carrier to the following formulation to prepare a carrier 8 having a weight-average particle diameter of 71 μm, a true specific gravity of 5.3, a D/h of 0.6, a volume resistivity of 13.5 [Log(Ω·cm)] and a magnetization of 69 A $m^2/kg$. The inorganic oxidized particulate material included in the layer had a coverage of 72% to the core material.

| | |
|---|---|
| Acrylic resin solution (solid content of 50% by weight) | 34.2 |
| Guanamine solution (solid content of 70% by weight) | 9.7 |
| Acidic catalyst (solid content of 20% by weight) | 0.19 |
| Silicone resin solution (solid content of 20% by weight of SR2410 from Dow Corning Toray Silicone Co., Ltd.) | 292.9 |
| Aminosilane (solid content of 100% by weight of SH6020 from Dow Corning Toray Silicone Co., Ltd.) | 0.42 |
| Inorganic particulate material A Aluminum oxide AKP-30 from Sumitomo Chemical Co., Ltd., having a particle diameter of 0.40 μm and a true specific gravity of 3.9 $g/cm^3$ | 60 |

-continued

| | |
|---|---|
| Inorganic particulate material B Titanium oxide MT-150A from Tayca Corp., having a particle diameter of 0.15 μm | 13.9 |
| Toluene | 800 |

The carrier 8 and the toner 1 were mixed in the same way as in Example 1 to prepare a developer and a supplemental developer.

Example 9

The procedure for preparation of the carrier 2 in Example 2 was repeated except for replacing the ferrite to a low-magnetized calcined ferrite having an average particle diameter of 52 μm and a true specific gravity of 5.3 to prepare a carrier 9 having a D/h of 1.1, a volume resistivity of 15.9 [Log(Ω·cm)] and a magnetization of 35 A $m^2/kg$. The inorganic oxidized particulate material included in the layer had a coverage of 94% to the core material.

The carrier 9 and the toner 1 were mixed in the same way as in Example 1 to prepare a developer and a supplemental developer.

Example 10

The procedure for preparation of the carrier 2 in Example 2 was repeated except for replacing the ferrite to a high-magnetized calcined magnetite having an average particle diameter of 54 μm and a true specific gravity of 5.5 to prepare a carrier 10 having a D/h of 1.1, a volume resistivity of 14.1 [Log(Ω·cm)] and a magnetization of 93 A $m^2/kg$. The inorganic oxidized particulate material included in the layer had a coverage of 102% to the core material.

The carrier 10 and the toner 1 were mixed in the same way as in Example 1 to prepare a developer and a supplemental developer.

Example 11

The procedure for preparation of the carrier 1 in Example 1 was repeated except for reducing the amount of the inorganic particulate material A from 92.9 to 45.4 to prepare a carrier 11 having a D/h of 1.0, a volume resistivity of 13.5 [Log(Ω·cm)] and a magnetization of 65 A $m^2/kg$. The inorganic oxidized particulate material included in the layer had a coverage of 41% to the core material.

The carrier 11 and the toner 1 were mixed in the same way as in Example 1 to prepare a developer and a supplemental developer.

Example 12

The procedure for preparation of the carrier 2 in Example 2 was repeated except for replacing the core material from F-300 from Powdertech Co., Ltd. to SM-350NV magnetite powder from Dowa Iron Powder Co., Ltd., having an average particle diameter of 52 μm and a true specific gravity of 5.1 $g/cm^3$ to prepare a carrier 12 having a D/h of 1.1, a volume resistivity of 14.8 [Log(Ω·cm)] and a magnetization of 71 A $m^2/kg$. The inorganic oxidized particulate material included in the layer had a coverage of 91% to the core material.

The carrier 12 and the toner 1 were mixed in the same way as in Example 1 to prepare a developer and a supplemental developer.

Example 13

The procedure for preparation of the supplemental developer in Example 12 was repeated except for filling 99 parts of the toner 1 and 1 parts of the carrier 12 in a developer container to prepare a supplemental developer.

Example 14

The procedure for preparation of the supplemental developer in Example 12 was repeated except for filling 75 parts of the toner 1 and 25 parts of the carrier 12 in a developer container to prepare a supplemental developer.

Example 15

The following materials were mixed with HENSCHEL MIXER to prepare a mixture.

| | |
|---|---|
| Polyester resin | 100 |
| Carnauba wax | 6 |
| Charge controlling agent E-84 from Orient Chemical Industries, Ltd. | 1.5 |
| C.I. Pigment Yellow 154 | 4 |

The mixture was melted and kneaded with a two-roll mill at 120° C. for 40 min to prepare a kneaded mixture. The kneaded mixture was cooled and hardened to prepare a hardened mixture. The hardened mixture was crushed with a hammer mill and pulverized with an air jet pulverizer to prepare a pulverized mixture. The pulverized mixture was classified to prepare toner particles 2 having an weight-average particle diameter of 5 μm.

As external additives, 1.5 parts of hydrophobic silica and 0.7 parts of hydrophobized titanium oxide were mixed with 100 parts of the toner particles by HENSCHEL MIXER at 2,000 rpm for 30 sec 5 times to prepare a toner 2.

5 parts of the toner 2 and 95 parts of the carrier 1 were mixed to prepare a developer having a toner concentration of 5% by weight. In addition, 90 parts of the toner 2 and 10 parts of the carrier 1 were filled in a developer container to prepare a supplemental developer. The properties of carriers (developers) prepared in each Example and Comparative Example are shown in Table 1. Color contamination, carrier adherence, image density and durability (charge quantity deterioration and resistivity variation) thereof were evaluated and the results are shown in Tables 2-1, 2-2 and 2-3.

Comparative Example 1

The following materials were dispersed with a homomixer for 10 min to prepare a silicone-resin-containing layer coating liquid.

| | |
|---|---|
| Silicone resin solution (solid content of 23% by weight of SR2410 from Dow Corning Toray Silicone Co., Ltd.) | 432.2 |
| Aminosilane (solid content of 100% by weight of SH6020 from Dow Corning Toray Silicone Co., Ltd.) | 0.66 |
| Inorganic particulate material A Aluminum oxide AKP-30 from Sumitomo Chemical Co., Ltd., having a particle diameter of 0.40 μm and a true specific gravity of 3.9 g/cm$^3$ | 92.9 |

-continued

| | |
|---|---|
| Carbon black MA100R from Mitsubishi Chemical Corp. | 20 |
| Toluene | 300 |

The coating liquid solution was coated and dried on 5,000 parts of a Cu—Zn ferrite powder F-300 from Powdertech Co., Ltd., having an average particle diameter of 55 μm and a true specific gravity of 5.2 g/cm$^3$ by SPIRA COTA from OKADA SEIKO CO., LTD. at a liquid flow rate of 40 g/min and an inner temperature of 40° C. such that the coated layer has a thickness of 0.35 μm. The resultant carrier material was calcined in an electric oven at 200° C. for 1 hr. After cooled, the carrier material was sieved through openings of 63 μm to prepare a carrier 13 having a D/h of 1.0, a volume resistivity of 12.9 [Log(Ω·cm)] and a magnetization of 68 A m$^2$/kg. The inorganic oxidized particulate material included in the layer had a coverage of 93% to the core material.

The carrier 13 and the toner 1 were mixed in the same way as in Example 1 to prepare a developer. The developer container was filled with only toner 1 as a supplemental developer.

[Image density 2]

The developer was set in a modified digital full-color printer imagio MP C4500, and every 3,000 pieces of two monochrome images having an image area of 0.5% and that of 50% was alternately produced until 300,000 pieces thereof were totally produced.

A solid image was produced on 6000 paper from Ricoh Company, Ltd. every time after 3,000 pieces of either of the two images were produced, and the image density thereof was measured by X-Rite from X-Rite Corp.

◎: ±0.15 or less

○: ±0.30 or less

Δ: +0.40 or less

X: ±0.41 or more

The printer was modified to have a developer container having a spiral developer guide race on the inner circumferential surface thereof, wherein a supplemental developer is directly fed from the developer container into the image developer.

[Durability 2]

The developer was set in a digital full-color printer imagio MP C4500 equally modified as in [Image density 2], and 300,000 pieces of a monochrome image having an image area of 50% were produced. Then, a charge loss of the developer was measured. In addition, 300,000 pieces of a monochrome image having an image area of 0.5% were produced. Then, a resistivity loss of the carrier was measured.

The procedure for evaluation of Example 1 was repeated to evaluate Comparative Example 1 except for the evaluations of the image density and durability, wherein the method of feeding the supplemental developer was changed as mentioned above. The results are shown in Tables 2-1, 2-2 and 2-3.

Comparative Example 2

The developer prepared in claim 1, having a toner concentration of 5% by weight was used. In addition, 90 parts of the toner 1 and 10 parts of the carrier 1 were filled in a developer container to prepare a supplemental developer.

[Image density 3]

The developer was set in a modified digital full-color printer imagio MP C4500, and every 3,000 pieces of two monochrome images having an image area of 0.5% and that of 50% was alternately produced until 300,000 pieces thereof were totally produced. A solid image was produced on 6000 paper from Ricoh Company, Ltd. every time after 3,000 pieces of either of the two images were produced, and the image density thereof was measured by X-Rite from X-Rite Corp.

◎: ±0.15 or less

○: ±0.30 or less

Δ: ±0.40 or less

X: ±0.41 or more

The printer was modified to have a developer container without a spiral developer guide race on the inner circumferential surface thereof, but has a sub-hopper, wherein a supplemental developer is fed from the developer container into the sub-hopper. The supplemental carrier was not fed from the developer container. In addition, the printer was modified such that a suitable amount of the developer is fed to the image developer in accordance with a detection signal such as a toner concentration sensor.

[Durability 3]

The developer was set in a digital full-color printer imagio MP C4500 equally modified as in [Image density 2], and 300,000 pieces of a monochrome image having an image area of 50% were produced. Then, a charge loss of the developer was measured. In addition, 300,000 pieces of a monochrome image having an image area of 0.5% were produced. Then, a resistivity loss of the carrier was measured.

The procedure for evaluation of Example 1 was repeated to evaluate Comparative Example 1 except for the evaluations of the image density and durability, wherein the method of feeding the supplemental developer was changed as mentioned above. The results are shown in Tables 2-1, 2-2 and 2-3.

Comparative Example 3

The developer prepared in Claim 1, having a toner concentration of 5% by weight was used. The developer container was filled with only toner 1 as a supplemental developer.

TABLE 1

| | C | T | VR | CSC | D/h (—) | MM | ID C/T | SD C/T |
|---|---|---|---|---|---|---|---|---|
| Example 1 | 1 | 1 | 14.9 | 85 | 1.0 | 65 | 95/5 | 10/90 |
| Example 2 | 2 | 1 | 15.4 | 98 | 1.1 | 65 | 95/5 | 10/90 |
| Example 3 | 3 | 1 | 15.8 | — | — | 66 | 95/5 | 10/90 |
| Example 4 | 4 | 1 | 13.1 | 72 | 2.0 | 72 | 95/5 | 10/90 |
| Example 5 | 5 | 1 | 14.5 | 107 | 0.4 | 64 | 95/5 | 10/90 |
| Example 6 | 6 | 1 | 16.3 | 100 | 0.6 | 64 | 95/5 | 10/90 |
| Example 7 | 7 | 1 | 15.7 | 71 | 0.9 | 66 | 95/5 | 10/90 |
| Example 8 | 8 | 1 | 13.5 | 72 | 0.6 | 69 | 95/5 | 10/90 |
| Example 9 | 9 | 1 | 15.9 | 94 | 1.1 | 35 | 95/5 | 10/90 |
| Example 10 | 10 | 1 | 14.1 | 102 | 1.1 | 93 | 95/5 | 10/90 |
| Example 11 | 11 | 1 | 13.5 | 41 | 1.0 | 65 | 95/5 | 10/90 |
| Example 12 | 12 | 1 | 14.8 | 91 | 1.1 | 71 | 95/5 | 10/90 |
| Example 13 | 12 | 1 | ↑ | ↑ | ↑ | ↑ | 95/5 | 1/99 |
| Example 14 | 12 | 1 | ↑ | ↑ | ↑ | ↑ | 95/5 | 25/75 |
| Example 15 | 1 | 2 | 14.9 | 85 | 1.0 | 65 | 95/5 | 10/90 |
| Comparative Example 1 | 13 | 1 | 12.9 | 93 | 1.1 | 68 | 95/5 | 10/90 |
| Comparative Example 2 | 1 | 1 | 14.9 | 95 | 1.0 | 65 | 95/5 | 10/90 |
| Comparative Example 3 | 1 | 1 | 13.8 | 93 | 1.0 | 65 | 95/5 | 0/100 |

C: carrier
T: toner
VR: volume resistivity of carrier (log Ω·cm)
CSC: core surface coverage (%)
MM: magnetic moment of carrier ($Am^2/kg$)
ID: initial developer (wt %)
SD: supplemental developer (wt %)

TABLE 2-1

| | Initial Evaluation | | | |
|---|---|---|---|---|
| | | Carrier Adherence | | After 30,000 |
| | Image density | Edge | White spot | Color contamination |
| Example 1 | ◎ | ◎ | ◎ | ○ |
| Example 2 | ◎ | ◎ | ◎ | ○ |
| Example 3 | ◎ | ○ | ◎ | ○ |
| Example 4 | ◎ | ◎ | ◎ | ○ |
| Example 5 | ◎ | ◎ | ◎ | ○ |
| Example 6 | ◎ | Δ | ◎ | ○ |
| Example 7 | ◎ | ○ | ◎ | ○ |
| Example 8 | ◎ | ◎ | ◎ | ○ |
| Example 9 | ◎ | ◎ | ◎ | ○ |
| Example 10 | ○ | ◎ | ◎ | ○ |
| Example 11 | ◎ | ◎ | ◎ | ○ |
| Example 12 | ◎ | ◎ | ◎ | ○ |
| Example 13 | ◎ | ◎ | ◎ | ○ |
| Example 14 | ◎ | ◎ | ◎ | ○ |
| Example 15 | ◎ | ◎ | ◎ | ○ |
| Comparative Example 1 | ◎ | ◎ | ◎ | X |
| Comparative Example 2 | ◎ | ◎ | ◎ | ○ |
| Comparative Example 3 | ◎ | ◎ | ◎ | ○ |

TABLE 2-2

| | Durability (25° C. 50% RH) After 150,000 | | | | |
|---|---|---|---|---|---|
| | CQD | RV | Carrier Adherence | | Image |
| | (μC/g) | (log Ω · cm) | Edge | White spot | density |
| Example 1 | 2 | 0.9 | ◎ | ◎ | ◎ |
| Example 2 | 3 | 0.2 | ◎ | ◎ | ◎ |
| Example 3 | 2 | 1.5 | ◎ | ○ | ◎ |
| Example 4 | 2 | 1.4 | ◎ | ◎ | ◎ |
| Example 5 | 4 | 0.2 | ◎ | ◎ | ◎ |
| Example 6 | 2 | 0.5 | ○ | ◎ | ◎ |
| Example 7 | 3 | 0.2 | ◎ | ◎ | ◎ |
| Example 8 | 2 | 1.4 | ◎ | ◎ | ◎ |
| Example 9 | 4 | 0.3 | ○ | ◎ | ◎ |
| Example 10 | 2 | 1.3 | ◎ | ◎ | ○ |
| Example 11 | 2 | 1.5 | ◎ | ○ | ◎ |
| Example 12 | 2 | 0.6 | ◎ | ◎ | ◎ |
| Example 13 | 4 | 1.5 | ○ | ◎ | ◎ |
| Example 14 | 2 | 0.3 | ◎ | ◎ | ◎ |
| Example 15 | 4 | 0.6 | ◎ | ◎ | ◎ |
| Comparative Example 1 | 3 | 0.5 | ◎ | ○ | X |
| Comparative Example 2 | 13 | 3.2 | ◎ | X | X |
| Comparative Example 3 | 12 | 3 | ◎ | Δ | X |

CQD: charge quantity deterioration
RV: resistivity variation

TABLE 2-3

| | Durability (25° C. 50% RH) After 300,000 | | | | |
|---|---|---|---|---|---|
| | CQD | RV | Carrier Adherence | | Image |
| | (μC/g) | (log Ω · cm) | Edge | White spot | density |
| Example 1 | 5 | 2.0 | ◎ | ◎ | ◎ |
| Example 2 | 6 | 0.4 | ◎ | ◎ | ◎ |
| Example 3 | 4 | 3.2 | ◎ | Δ | ◎ |

TABLE 2-3-continued

| | Durability (25° C. 50% RH) After 300,000 | | | | |
|---|---|---|---|---|---|
| | CQD | RV | Carrier Adherence | | Image |
| | (μC/g) | (log Ω · cm) | Edge | White spot | density |
| Example 4 | 4 | 3.0 | ◎ | Δ | ◎ |
| Example 5 | 9 | 0.3 | ◎ | ◎ | ◎ |
| Example 6 | 5 | 1.2 | ◎ | ◎ | ◎ |
| Example 7 | 7 | 0.4 | ◎ | ◎ | ◎ |
| Example 8 | 4 | 2.8 | ◎ | ◎ | ◎ |
| Example 9 | 8 | 0.5 | ○ | ◎ | ◎ |
| Example 10 | 4 | 2.5 | ◎ | ◎ | ○ |
| Example 11 | 5 | 2.9 | ◎ | ○ | ◎ |
| Example 12 | 5 | 1.2 | ◎ | ◎ | ◎ |
| Example 13 | 9 | 2.9 | ○ | ○ | ◎ |
| Example 14 | 4 | 0.5 | ◎ | ◎ | ◎ |
| Example 15 | 8 | 1.3 | ◎ | ◎ | ◎ |
| Comparative Example 1 | 8 | 1.3 | ◎ | ○ | X |
| Comparative Example 2 | — | — | — | — | — |
| Comparative Example 3 | — | — | — | — | — |

CQD: charge quantity deterioration
RV: resistivity variation

As Tables 2-1, 2-2 and 2-3 show, good carries were prepared and quality images without color contamination were produced Examples 1 to 14 within the present invention, and they produced good results of all image density, carrier adherence, charge quantity deterioration and resistivity variation. In Example 14, the carrier remained in the developer container. The image quality was not influenced, but waste carrier increases.

Images with color contamination practically unusable were produced in Comparative Example 1. The image density was not stable. Further, the supplemental developer feeder scattered the toner in the apparatus. Comparative Examples 2 produced quality images until 30,000 were produced, but the resistivity of the carrier deteriorated when 150,000 images were produced, resulting in production of white spot images. Charge quantity also deteriorated and the evaluation was stopped on the way. Almost no carrier was fed from the developer container. Comparative Examples 3 produced quality images until 30,000 were produced as well, but the resistivity of the carrier deteriorated when 150,000 images were produced, resulting in production of white spot images. Charge quantity also deteriorated and the evaluation was stopped on the way.

This application claims priority and contains subject matter related to Japanese Patent Application No. 2007-005389 filed on Jan. 15, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:
an image bearer configured to bear an image;
a charger configured to charge the image bearer;
an irradiator configured to irradiate the image bearer to form an electrostatic latent image thereon;
an image developer configured to develop the electrostatic latent image with a developer comprising a toner and a carrier to form a toner image on the image bearer;
a transferer configured to transfer the toner image onto a receiving material;
a fixer configured to fix the toner image on the receiving material;
a developer feeder configured to feed a supplemental developer comprising the toner and the carrier into the image developer; and
a developer collector configured to collect the developer in the image developer,
wherein the developer feeder includes
a cylindrical supplemental developer container configured to contain the supplemental developer, the cylindrical supplemental developer container including a spiral developer guide race on the inner circumferential surface thereof;
an air feeder; and
a sub-hopper configured to store the supplemental developer,
wherein the air feeder is located between the supplemental developer container and the sub-hopper and is configured to feed the supplemental developer to the sub-hopper from the supplemental developer container, and wherein the sub-hopper stirs and feeds the supplemental developer to the image developer, and
wherein the carrier has a true specific gravity greater than $4g/cm^3$ and includes
a core material; and
a layer coated on the core material, the layer including a binder resin and non-black or a non-color inorganic particulate material.

2. The image forming apparatus of claim 1, wherein the carrier satisfies the following relationship:

$$0.5<D/h<1.5$$

wherein D represents a particle diameter of the inorganic particulate material included in the layer coated on the core material and h represents a thickness thereof.

3. The image forming apparatus of claim 1, wherein the binder resin comprises an acrylic resin and a silicone resin.

4. The image forming apparatus of claim 1, wherein the carrier has a volume resistivity of from 10 to 16 Log(Ω·cm).

5. The image forming apparatus of claim 1, wherein the carrier has a volume-average particle diameter of from 20 to 65 μm.

6. The image forming apparatus of claim 1, wherein the carrier has a magnetic moment of from 40 to 90 A $m^2$/kg at 1,000 Oe.

7. The image forming apparatus of claim 1, wherein the carrier has a weight ratio of from 3 to 20% based on total weight of the developer.

8. A process cartridge detachable from an image forming apparatus, comprising
an image bearer configured to bear an image; and
an image developer configured to develop a latent image on the image bearer with a developer comprising a toner,
wherein the image forming apparatus is the image forming apparatus according to claim 1.

9. An image forming method using the image forming apparatus of claim 1, comprising:
charging an image bearer;
irradiating the image bearer to form an electrostatic latent image thereon;
developing the electrostatic latent image with a developer comprising a toner and a carrier to form a toner image on the image bearer by an image developer;

transferring the toner image onto a receiving material;

fixing the toner image on the receiving material;

feeding a supplemental developer comprising the toner and carrier into the image developer with a developer feeder; and collecting the developer in the image developer, wherein the developer feeder comprises:

a cylindrical supplemental developer container configured to contain the supplemental developer, comprising a spiral developer guide race on the inner circumferential surface thereof; and a sub-hopper configured to store the supplemental developer, and wherein the carrier comprises:

a core material; and a layer coated on the core material, comprising a binder resin and non-black or a non-color inorganic particulate material.

10. An image forming method using the image forming apparatus of claim 1, comprising:

charging an image bearer;

irradiating the image bearer to form an electrostatic latent image thereon;

developing the electrostatic latent image with a developer comprising a toner and a carrier to form a toner image on the image bearer by an image developer;

transferring the toner image onto a receiving material;

fixing the toner image on the receiving material;

feeding a supplemental developer comprising the toner and carrier into the image developer with a developer feeder; and collecting the developer in the image developer, wherein the developer feeder comprises:

a cylindrical supplemental developer container configured to contain the supplemental developer, comprising a spiral developer guide race on the inner circumferential surface thereof; and a sub-hopper configured to store the supplemental developer, and wherein at least the image bearer and the image developer are included in a process cartridge detachable from the image forming apparatus, the process cartridge including the image bearer and the image developer.

11. The image forming apparatus of claim 1, wherein the particulate material is a surface-treated inorganic particulate material.

* * * * *

UNITED STATES PATENT AND TRADEMARK OFFICE

CERTIFICATE OF CORRECTION

PATENT NO. : 8,213,833 B2
APPLICATION NO. : 12/013108
DATED : July 3, 2012
INVENTOR(S) : Shinichiro Yagi et al.

It is certified that error appears in the above-identified patent and that said Letters Patent is hereby corrected as shown below:

On the title page, Item (75), the fourth inventor's information is incorrect. Item (75) should read:

-- (75) Inventors: Shinichiro Yagi, Numazu (JP); Tomio Kondou, Numazu (JP); Masashi Nagayama, Mishima (JP); Hitoshi Iwatsuki, Numazu (JP) --

Signed and Sealed this
Twenty-fifth Day of September, 2012

David J. Kappos

David J. Kappos
*Director of the United States Patent and Trademark Office*